US006240930B1

(12) United States Patent
Yuhara

(10) Patent No.: US 6,240,930 B1
(45) Date of Patent: Jun. 5, 2001

(54) SEALED COSMETIC CASE

(75) Inventor: Yukitomo Yuhara, Chiba (JP)

(73) Assignee: Yoshida Industries Co., Ltd., Tokyo (JP)

( * ) Notice: Subject to any disclaimer, the term of this patent is extended or adjusted under 35 U.S.C. 154(b) by 0 days.

(21) Appl. No.: 09/511,451

(22) Filed: Feb. 23, 2000

(30) Foreign Application Priority Data

Feb. 23, 1999 (JP) ..... 11-045439
Feb. 23, 1999 (JP) ..... 11-045440
Feb. 23, 1999 (JP) ..... 11-045441

(51) Int. Cl.[7] ..... A45D 33/00
(52) U.S. Cl. ..... 132/293; 206/235
(58) Field of Search ..... 132/293, 294, 132/295; 206/581, 235; 220/849, 848, 844

(56) References Cited

U.S. PATENT DOCUMENTS 2,410,585 * 11/1946 Leitner ..... 132/295
4,569,438 * 2/1986 Sheffler ..... 206/235
5,568,820 * 10/1996 Dirksing ..... 132/295
5,638,838 * 6/1997 Lombardi ..... 132/295

FOREIGN PATENT DOCUMENTS 58-36331 8/1983 (JP) .
60-24209 2/1985 (JP) .
62-159353 10/1987 (JP) .
3-114110 11/1991 (JP) .
3-119310 12/1991 (JP) .
7-227313 8/1995 (JP) .
9-108035 4/1997 (JP) .
9-286455 11/1997 (JP) .

* cited by examiner

*Primary Examiner*—Todd E. Manahan
(74) *Attorney, Agent, or Firm*—Harness, Dickey & Pierce, P.L.C.

(57) ABSTRACT

A cosmetic case comprised of an upper cover, lower container, pivoting hinge assembly, and latch mechanism utilized to secure the cover against the container to form an atmospheric seal between the cover and container. The hinge assembly is specifically structured so as to provide an elastic deformation property which allows positional displacement of the hinge pin as means of compensating for dimensional differences between the cover and container that would otherwise adversely affect the atmospheric seal.

11 Claims, 21 Drawing Sheets

SEALED COSMETIC CASE

BACKGROUND OF THE INVENTION

1. Field of the Invention

The invention relates to a small portable cosmetic case with an atmospherically sealed inner compartment.

2. Description of the Related Art

Abstract

Portable sealed cosmetic containers, commonly called compacts, are commonly employed to carry personal use cosmetics. The structure of the compact is generally comprised of an outer case provided with an internal cosmetic holding container. A cover is connected to the case by means of a pivoting hinge located at the rear of the compact, and is thus able to pivot against the case and seal the cosmetic container from the atmosphere. A releasable latch mechanism is provided at the front of the compact as means of holding the cover against the container part to maintain the seal.

In order to maintain an effective seal against the external environment, compact designs sometimes make use of an elastic packing piece attached to the underside of the cover, such as that proposed by Japanese Examined Utility Model Publication No. 6-2585(B2). When the cover is closed, the packing piece comes into pressure contact against perimeter of the container and thus seals the cosmetic material from the external environment.

Furthermore, Japanese Unexamined Patent Publication No. 8-347(A1) puts forth an elastic packing piece, incorporating an inverted U-shaped cross section, installed around the perimeter of the cosmetic holding container. By closing the cover, the cover packing piece and a packing piece around the internal cosmetic container come into mutual pressurized contact to create an atmospheric seal. This structure is designed to maintain the atmospheric seal even when the packing pieces and cosmetic container have undergone a certain amount of distortion.

Moreover, with the purpose of maintaining an effective seal, the hinge pin of the aforesaid of compact is rigidly supported by the compact's cover and container as means of preventing looseness there between.

As this design maintains a rigid pivoting connection between the compact's cover and container, small dimensional variations between these two parts have the effect of distorting their shape when the cover is closed and the latch mechanism engaged. When the container and/or cover part become distorted in this manner the atmospheric seal can be easily broken. That is, this type of distortion can induce misalignment between the cover and container when the compact is closed, a problem which results in uneven pressure being applied against the packing piece and breaking of the atmospheric seal.

Moreover, uneven pressure applied against the packing piece has the effect of generating excessive wear at certain locations thereon, thus leading to premature breakdown of its elastic sealing property.

SUMMARY OF THE INVENTION

The invention provides means of maintaining uniform pressure on each part of the packing piece in the closed condition of the compact's cover according to an engagement of the latch mechanism, by employing various types of voids or gaps in the pivoting hinge assembly between the compact's cover and container parts, whereby creating a more effective long term seal between the compact's cover and container and lengthening the service life of the packing piece.

The cosmetic case described by this invention is comprised of a container part within which a cosmetic holding space is provided, a cover part capable of pivotably exposing or sealing the cosmetic holding space, a hinge pin provided between the cover part and container part as means of allowing their pivotal rotation thereon, a latch mechanism capable of releaseably securing the cover part against the container part, a packing piece provided as means of forming an atmospherically tight seal between the cover part and cosmetic holding space according to a securing motion of the latch mechanism, and an elastic deformation structure, formed either on the cover part or container part, as means of allowing a positional displacement of the hinge pin when the cover part is held closed against the container part by the latch mechanism.

The elastic deformation structure operates in a manner as to allow the positional displacement of the hinge pin connecting the cover and container parts, thus eliminating the possibility of generating dimensional distortion in the cover and/or container part as a result of the secured latch mechanism, thus allowing uniform pressure to be applied against the packing piece regardless of dimensional manufacturing irregularities which may be present in the cover and container part, and thus providing for a mechanism through which the effective sealing property of the cosmetic case can be maintained over a long period of time.

Moreover, the effective service life of the packing piece is extended because the invention provides means of establishing more uniform sealing pressure on the packing piece.

The invention also provides for a structure in which the container part incorporates a container hinge boss, the cover part incorporates a cover hinge boss, the hinge pin inserts through both of the hinge bosses to form a pivoting joint, and the elastic deformation structure is provided as part of either the container hinge boss or cover hinge boss.

The part of the container hinge boss between the hinge pin and container part may be thinly formed in cross section and shaped so as to provide a flexible gap between the hinge pin and container part.

The part of the container hinge boss located between the hinge pin and container part may be narrowly formed so as to allow a predominantly open space between the hinge pin and container part.

The part of the cover hinge boss between the hinge pin and cover part may be thinly formed in cross section and shaped to provide a flexible gap between the hinge pin and cover part.

The part of the cover hinge boss located between the hinge pin and cover part may be narrowly formed so as to allow a predominantly open space between the hinge pin and cover part.

In cases where the hinge boss is structured to include the thin cross section, that thin cross section provides an elastic deformation property allowing the area between the container and hinge or cover and hinge to elongate or compress, thus allowing the hinge pin to pivot and positionally displace in fore-aft, horizontal, and vertical directions.

If the hinge boss is structured to include the narrowly formed part, that narrowly formed part provides an elastic deformation property that allows the hinge boss to bend in relation to the container and cover. That is, the hinge pin is able to rotate while displacing in fore-aft, horizontal, and vertical directions while also torsionally twisting on an axis perpendicular to the hinge pin.

The invention also provides for a cosmetic case structure in which a container hinge boss is formed on the container part, a cover hinge boss is formed on the cover part, a hinge pin is formed as an integral part of either the container hinge boss or cover hinge boss, and a hinge connecting and releasing structure is provided as part of the corresponding hinge boss not containing the integral hinge pin, and the elastic deformation structure is provided either on the container hinge boss or cover hinge boss.

The aforesaid structure eliminates the necessity of inserting a separate hinge pin into the hinge bosses and allows for the easy removal of the cover from the container, thus simplifying the process by which the cosmetic material is placed into the cosmetic case at the time of manufacture.

The invention also provides for a structure in which the container part is defined by a sidewall, the cover part incorporates a cover plate able to close over the container part, the elastic deformation structure is formed into either the sidewall or cover plate as a flat spring structure, and the hinge pin mutually joins the sidewall and cover plate through the flat spring structure.

The flat spring structure may be formed by parallel slits opened vertically within and through the sidewall.

The flat spring structure may be formed by vertical parallel grooves adjacently provided in the sidewall.

The flat spring structure may be formed by means of a portion of the sidewall having a thinner cross section.

The flat spring structure may be formed by adjacent horizontal parallel slits opened in the cover plate.

The flat spring structure may be formed by horizontal parallel grooves adjacently provided in the cover plate.

The flat spring structure may be formed as a portion of the cover plate having a thinner cross section.

The slits, grooves, and thinner wall section all provide for an operation identical or similar to that of a cantilevered flat spring to occur between the container and cover plate, thus allowing one or both of the hinge bosses to positionally displace in relation to the container and or cover. The hinge pin is thus able to pivot while also positionally displacing in fore-aft, horizontal, and vertical directions.

DESCRIPTION OF THE PREFERRED EMBODIMENT

Figure 1:
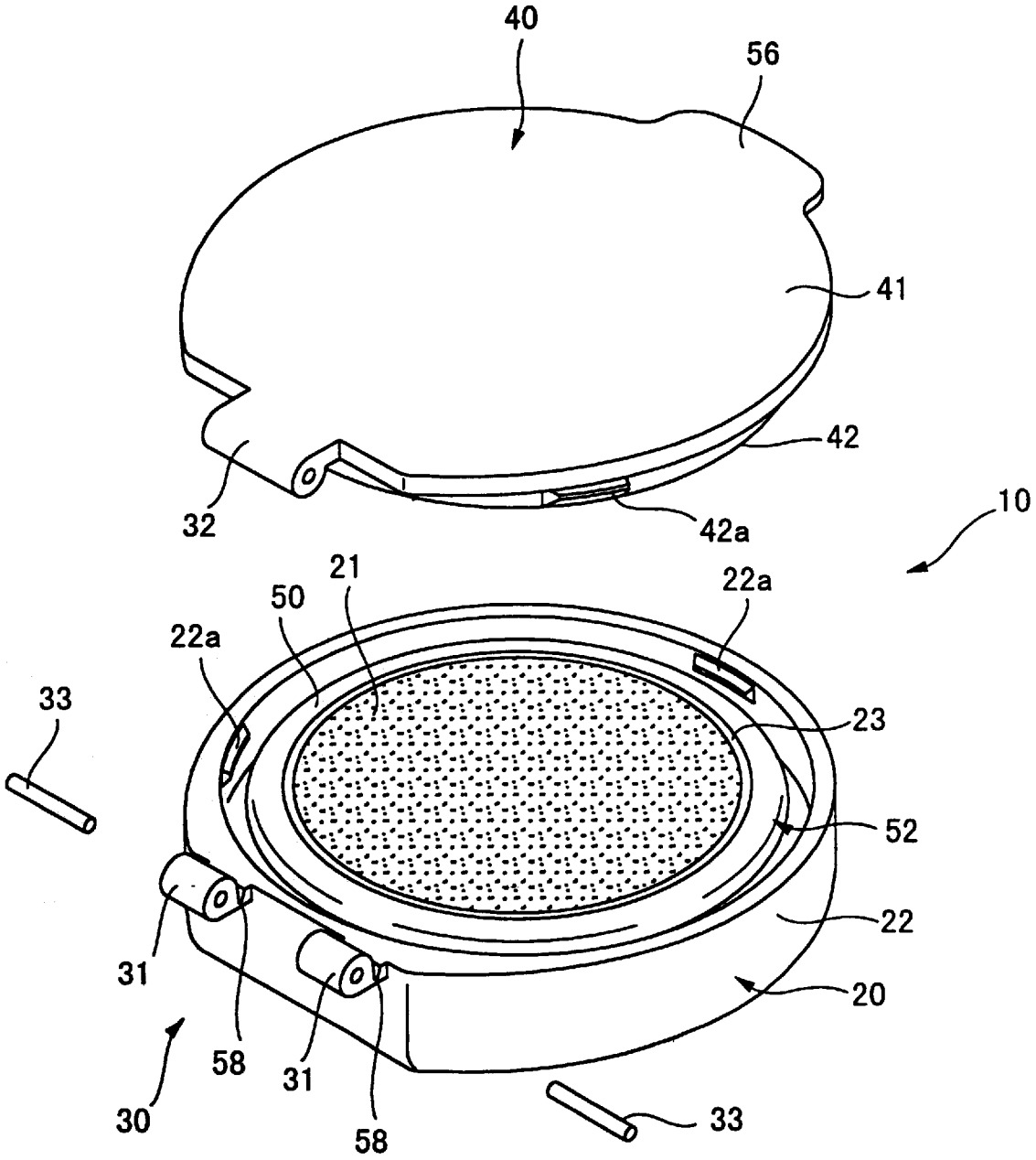
FIG. 1 is an oblique exploded view of the first embodiment of the invention.
Figure 2:
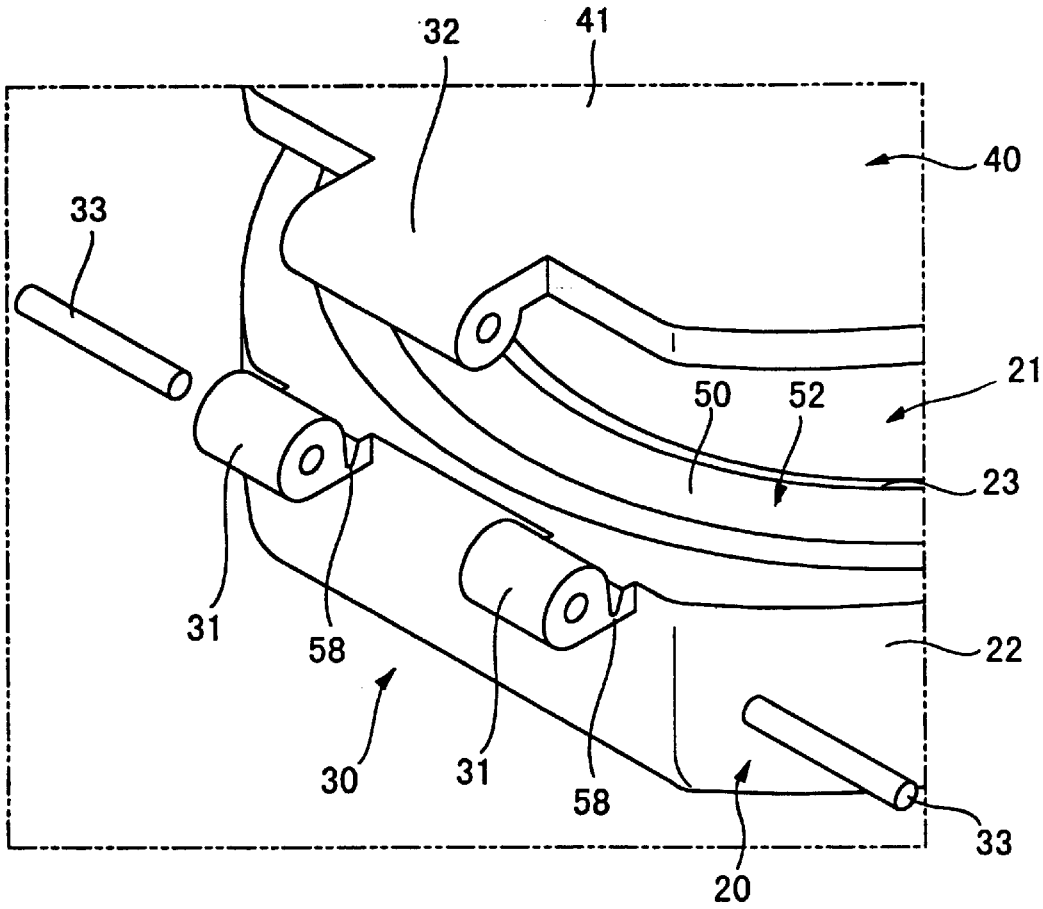
FIG. 2 is a detailed oblique view of the hinge assembly of the first embodiment.
Figure 3:
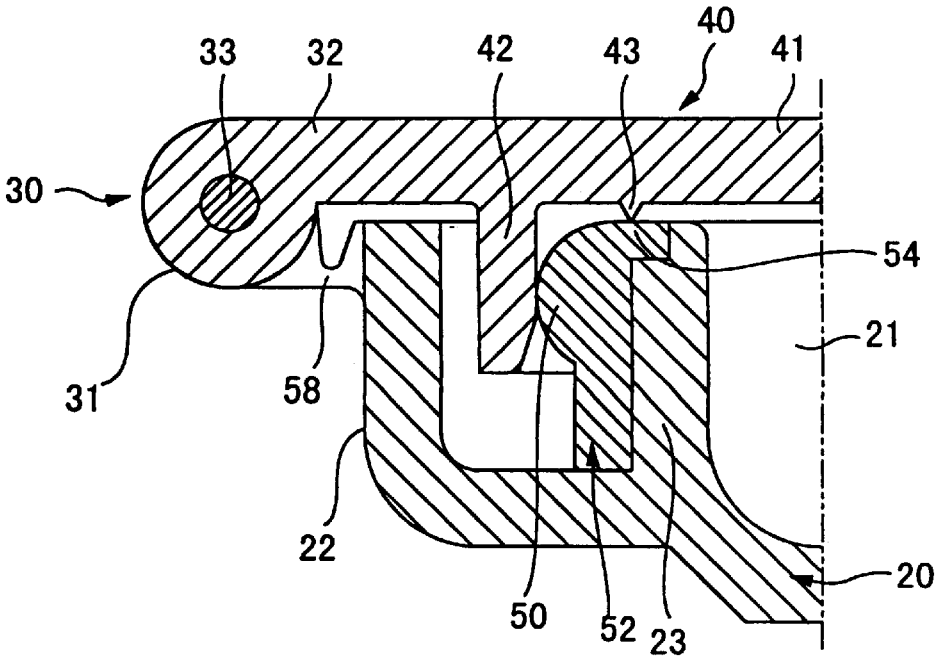
FIG. 3 is a cross section of the hinge and sealing structure of the first embodiment.
Figure 4:
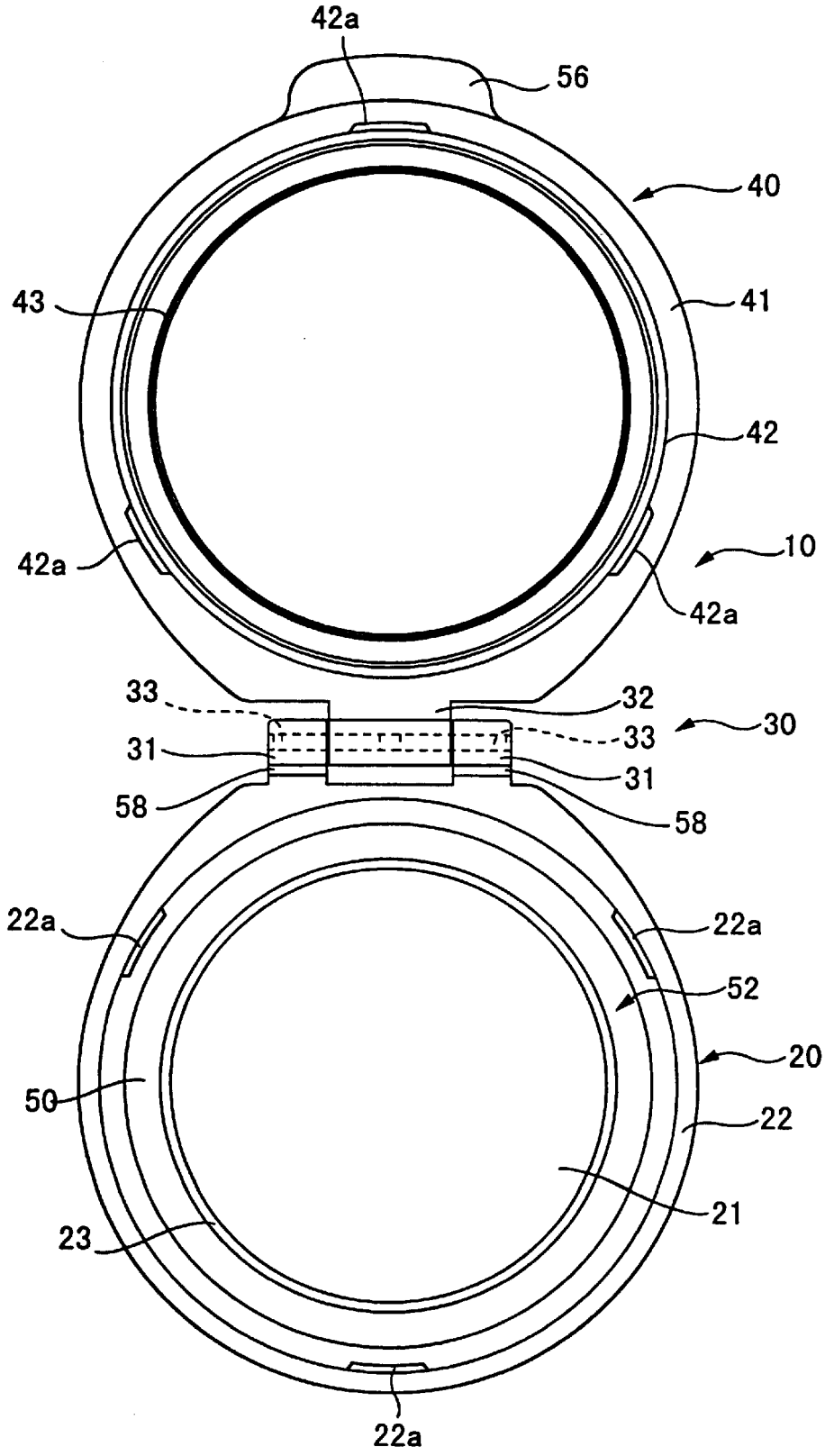
FIG. 4 is a plan view of the first embodiment with the cover open.
Figure 5:
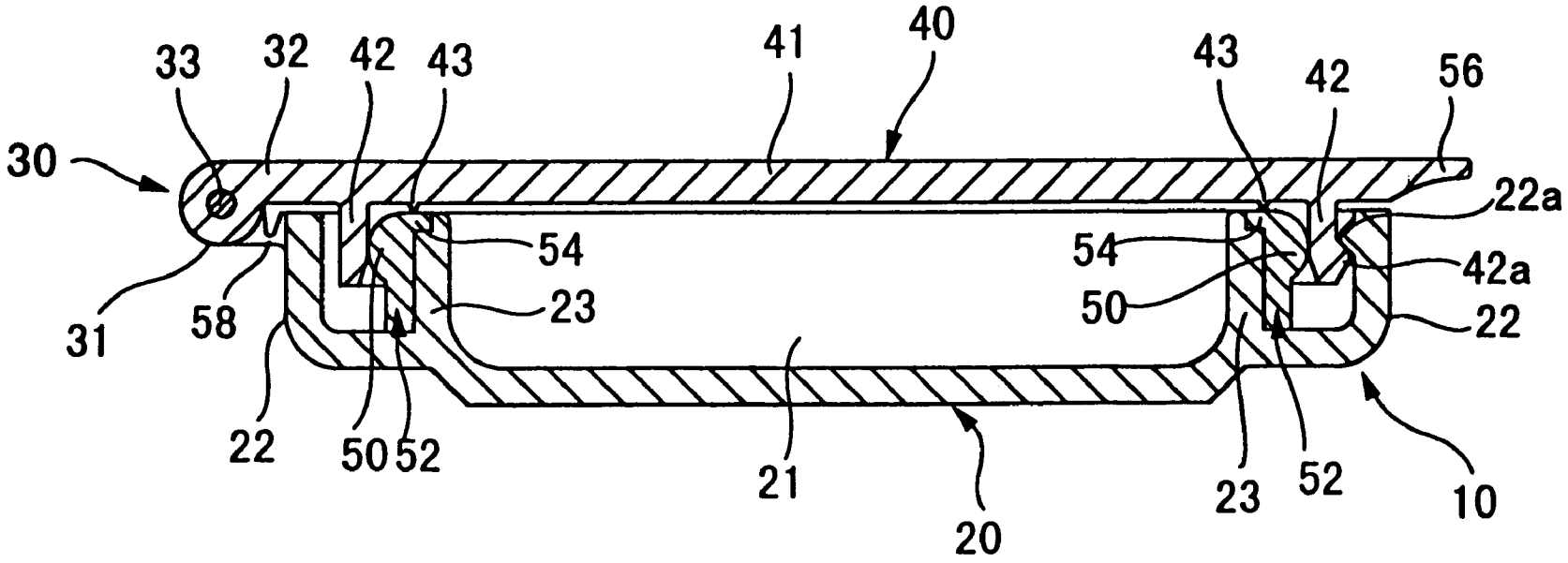
FIG. 5 is a side cross sectional view of the first embodiment with the cover closed.

The following will discuss embodiments of the invention with reference to the attached figures.

FIGS. 1 through 5 describe a first embodiment of the invention. Cosmetic case 10 is comprised of container 20 to which cosmetic space 21 is formed therein, cover 40, hinge pin 33 removably installed to and between both cover 40 and container 20 so as to allow their pivotal movement there around, a latch mechanism comprised of first fingers 22*a* formed on container 20 and second fingers 42*a* formed on cover 40; the latch mechanism operating so as to releasably secure cover 40 against container 20 when cosmetic case 10 is closed, packing part 52 provided as means of forming an atmospherically tight seal between cover 40 and cosmetic space 21, and an elastic deformation structure, formed either on cover 40 or container 20, as means of allowing the positional displacement of hinge pin 33 when cover 40 is closed against container 20.

Container hinge boss 31 is integrally formed to container 20, and cover hinge boss 32 is integrally formed to cover 40. Boss 31 and 32 are pivotably connected on the same axis by means of hinge pin 33 being inserted therein. Either boss 31 or 32 may be formed to allow the rotational movement of hinge pin 33 therein.

The material part connecting hinge boss 31 to container 20 is formed as an elastic deformation structure in which a relatively thin elastically deformable cross section is provided by thin boss member 58.

As shown in the figures, cosmetic case 10 is comprised of container 20 into which cosmetic storage space 21 is formed, and cover 40 pivotably attached to the rear side of container 20 by means of-hinge 30. Container 20 includes integrally formed external sidewall 22 that defines a tray-shaped area there within. Circular wall 23 is formed within the space defined by external sidewall 22. Packing piece 52, which incorporates radially extending packing flange 50, is installed around the perimeter of circular wall 23. Tray shaped cosmetic storage space 21 is provided within the area defined by packing piece 52. First latch fingers 22*a* are provided at three points uniformly separated on the inner circumference of sidewall 22.

Hinge assembly 30 is comprised of two lower hinge bosses 31 that extend outward from the center of the rear edge of container 20, cover hinge boss 32 formed at the center of the rear edge of cover 40 and positioned so as to reside between lower hinge bosses 31, and hinge pin 33 that inserts within hinge bosses 31 and 32 so as to provide for a pivotable connection there between.

Cover 40 incorporates top plate 41 that covers cosmetic space 21 when cover 40 is closed against container 20. Circular wall 42 is formed on the underside of top plate 41, and second latch fingers 42*a* are formed on the perimeter of circular wall 42 and positioned so as to form a releasable connection with first latch fingers 22*a* when cover 40 is closed against container 20. Circular sealing ridge 43 is formed on the underside of cover 40 radially inward of circular wall 42, and comes into pressure contact with upper packing piece surface 54 when cover 40 is closed over container 20. Flange 56 is provided on the front edge of cover 40, opposite to hinge 30, as means of pushing open cover 40.

The embodiment provides for a structure in which hinge bosses 31, as well as hinge pins 33, are connected to external side wall by means of thin connector member 58, the member incorporating a V-shape cross section that is partially connected to hinge boss 31. Hinge boss 31 is thus allowed to positionally displace by means of opening or closing elastic deformation of the V-shape cross section of thin connecting member 58, thus allowing the fore-aft, horizontal, and vertical displacement of hinge pin 33 as well as its fore-aft, horizontal, and vertical axial rotational movement.

Pressing cover 40 down against container 20 results in the mutual connection of 1st and 2nd latch fingers 22*a* and 42*a*, thus forming a locked but releasable closure between cover 40 and container 20. As cover 40 closes against container 20, the inner perimeter of circular wall 42 slides against and forms a sealed joint with flange 50 of packing piece 52, and the latch fingers mutually interconnect. Moreover, circular ridge 43 of cover 40 comes into simultaneous contact with upper packing surface 54. The multiple sealing structures thus formed maintain an atmospherically tight seal of cosmetic space 21. Pushing upward on cover flange 56 will release the connection formed between first and second fingers 22*a* and 42*a*, and thus allow cover 40 to pivot into an open position which allows access the cosmetic space 21.

As hinge assembly 30 is able to displace through the deformation of thin connecting members 58, a structure is provided which allows dimensional differences between cover 40 and container 20 to be absorbed, when first and second fingers 22 and 42*a* are mutually connected, as means of eliminating material distortion in the cosmetic case when cover 40 is closed. This mechanism provides for a highly efficient seal between cover 40 and container 20 by means of a uniform and evenly distributed contact pressure maintained between packing piece 52, cover 40, and container 20. A tight atmospheric seal is thus created as means of preventing evaporation and deterioration over time of the cosmetic material contained in space 21. Moreover, the uniform pressure applied against packing piece 52 by cover 40 and container 20 acts to prolong the usable service life of packing piece 52.

Figure 6:
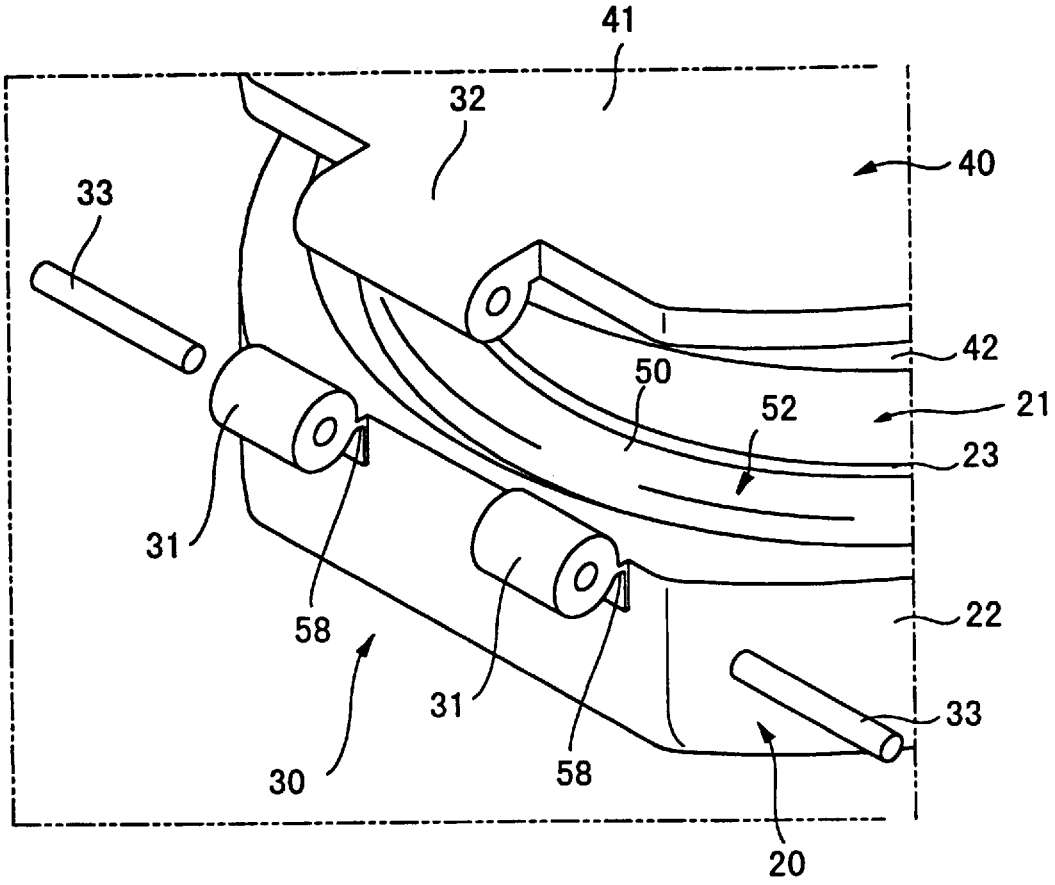
FIG. 6 is a detailed oblique view of the hinge assembly of the second embodiment of the invention.
Figure 7:
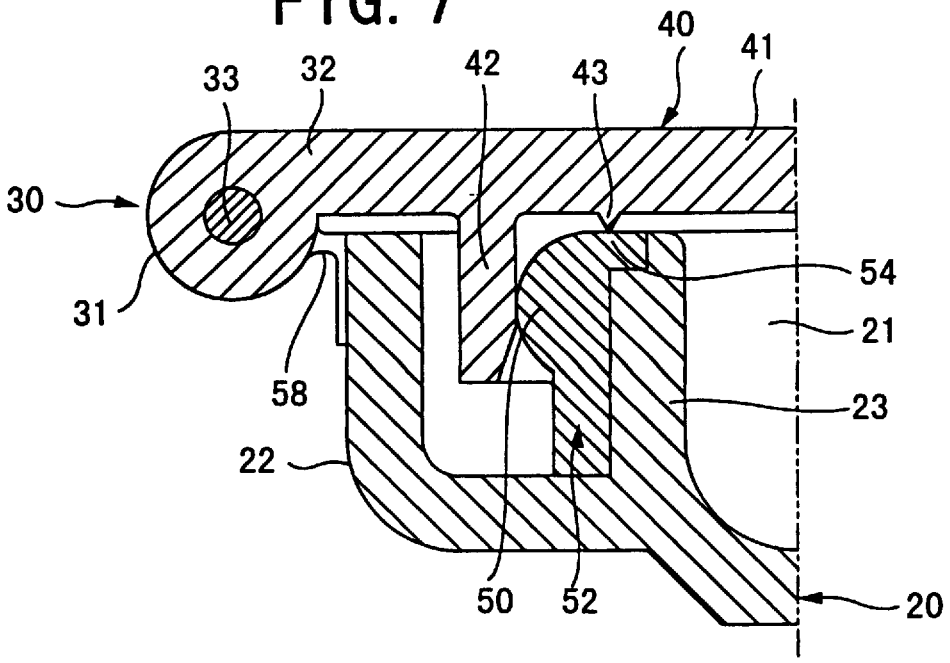
FIG. 7 is a cross sectional view of the hinge assembly and sealing part of the second embodiment.

FIGS. 6 and 7 describe a second embodiment of the invention wherein thin connecting member 58 incorporates an inverted V-shaped cross section as means of joining container 20 to container hinge boss 31. Due to its thin V-shaped cross section, connecting member 58 is able to provide an elastic deformation property that allows the positional displacement of hinge boss 31 in the same manner as put fourth in the first embodiment.

Figure 8:
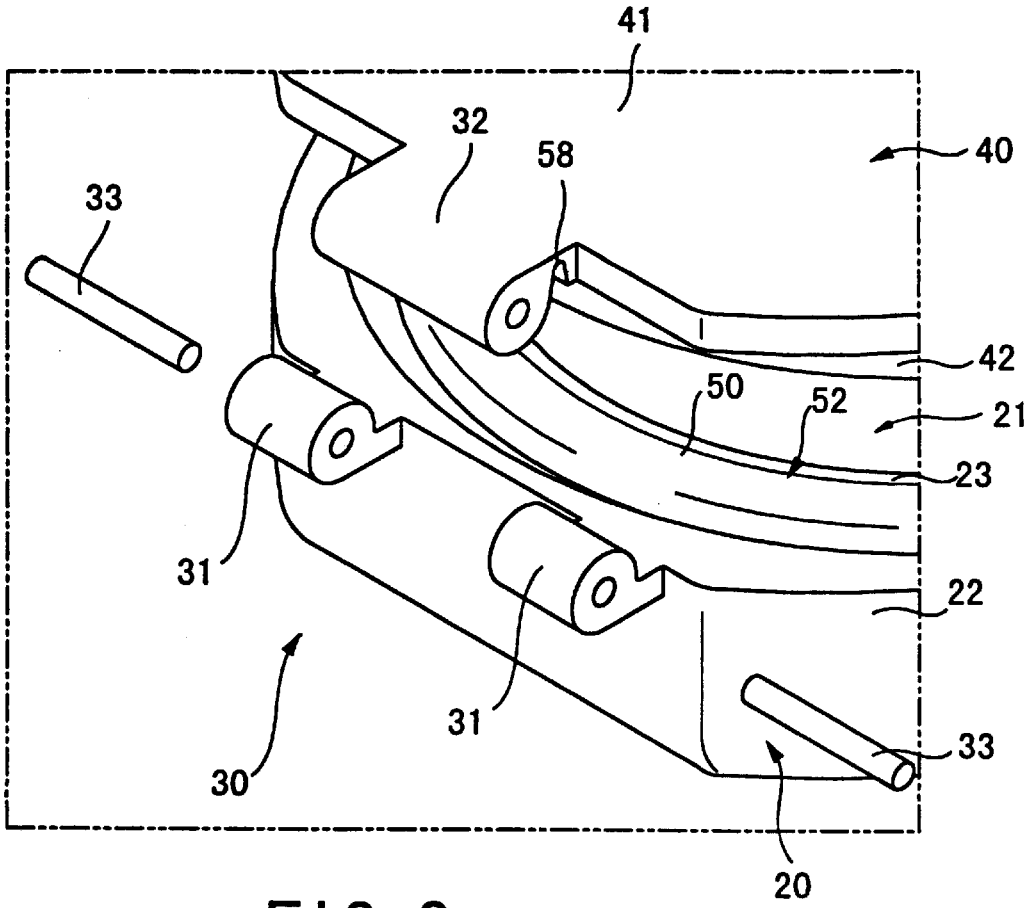
FIG. 8 is a detailed oblique view of the hinge assembly of the third embodiment.
Figure 9:
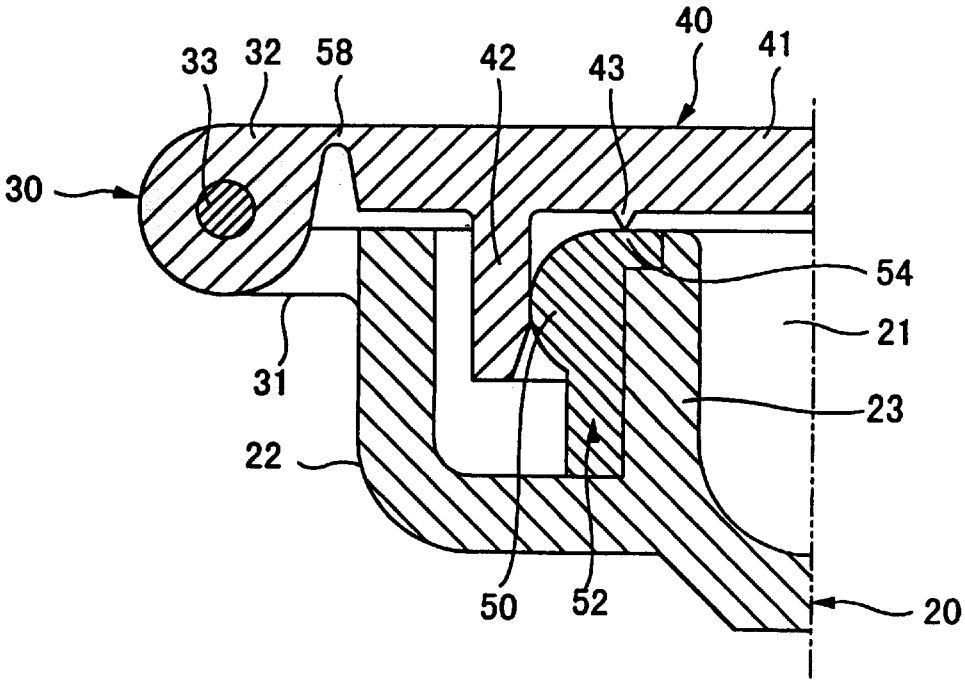
FIG. 9 is a cross sectional view of the hinge assembly and sealing part of the third embodiment.

FIGS. 8 and 9 describe a third embodiment of the invention wherein the material connecting cover hinge boss 32 to cover 40 is formed to a narrow cross section in a manner as to provide for a flexible gap in the area between connecting cover 40 and hinge pin 33.

As shown in the figures, thin connecting member 58 joins the upper area of cover boss 32 to top plate 41 through an inverted V-shaped cross section. The void part of this cross section extends in the axial direction along hinge pin 33. The elastic deformation property of thin connecting member 58 allows the displaced positional movement of hinge 32 as described in the previous first and second embodiments. This third embodiment thus provides for the same operational effects offered by the first and second embodiments.

Figure 10:
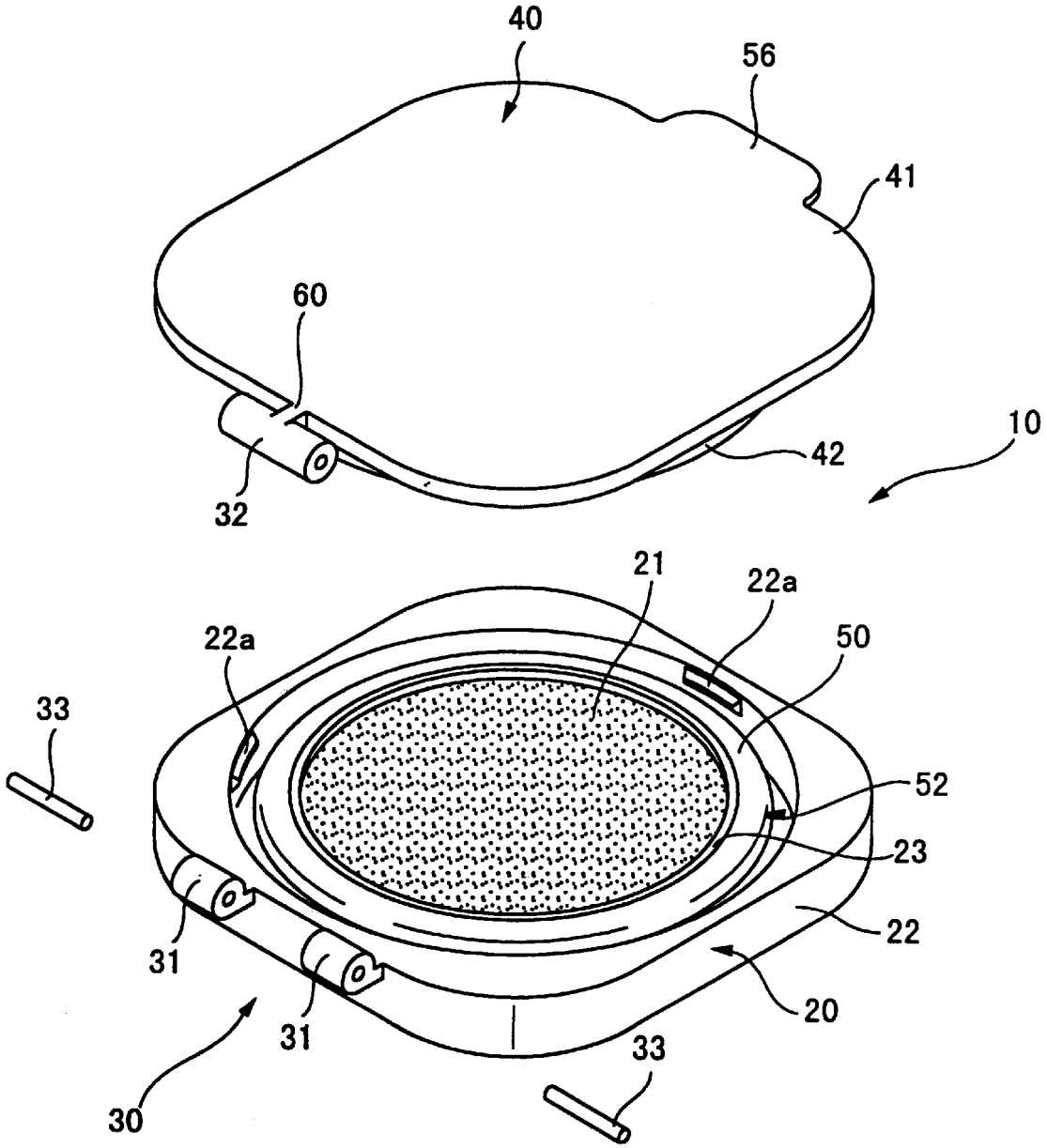
FIG. 10 is an exploded oblique view of the fourth embodiment of the invention.
Figure 11:
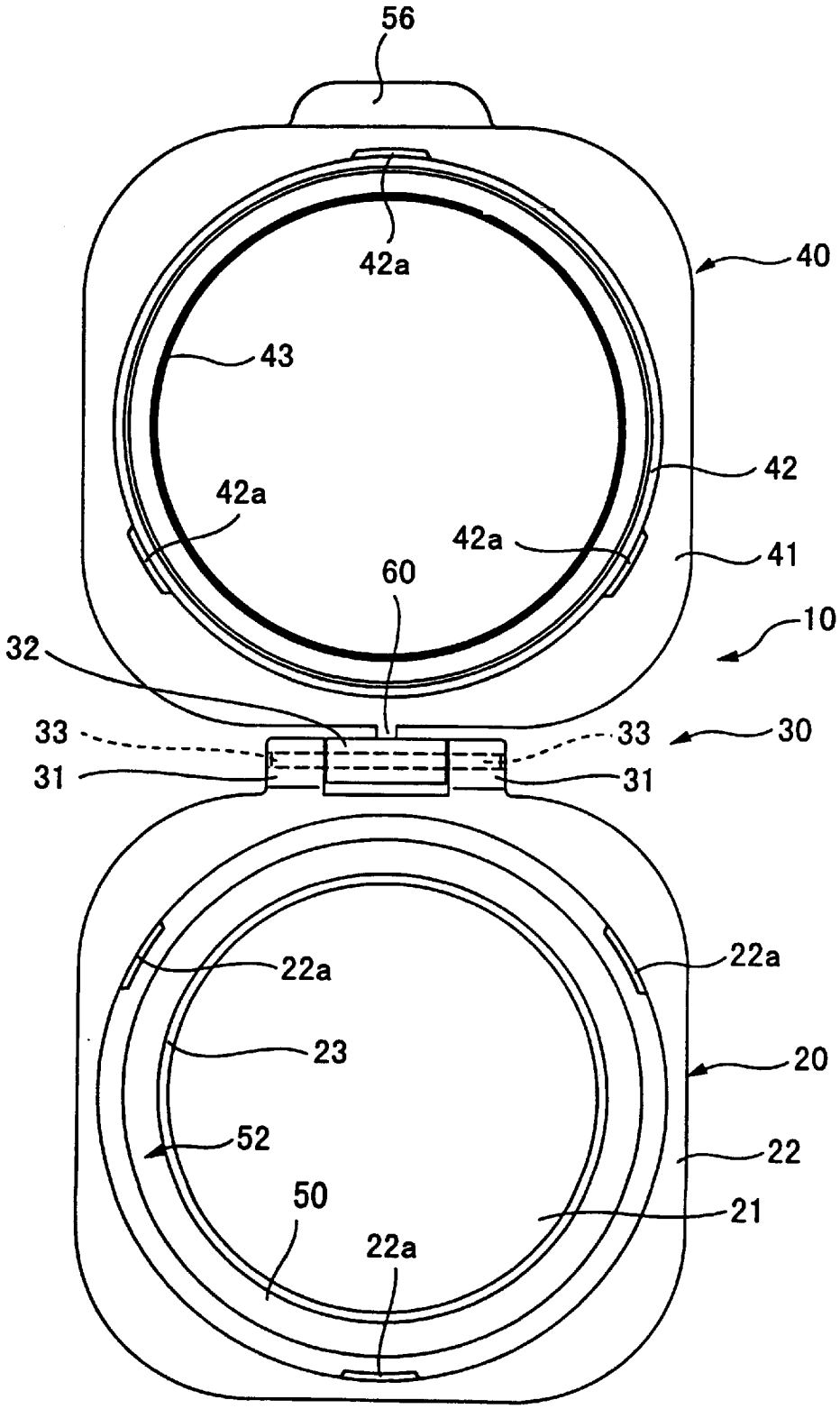
FIG. 11 is a plan view of the fourth embodiment shown with the cover open.
Figure 12:
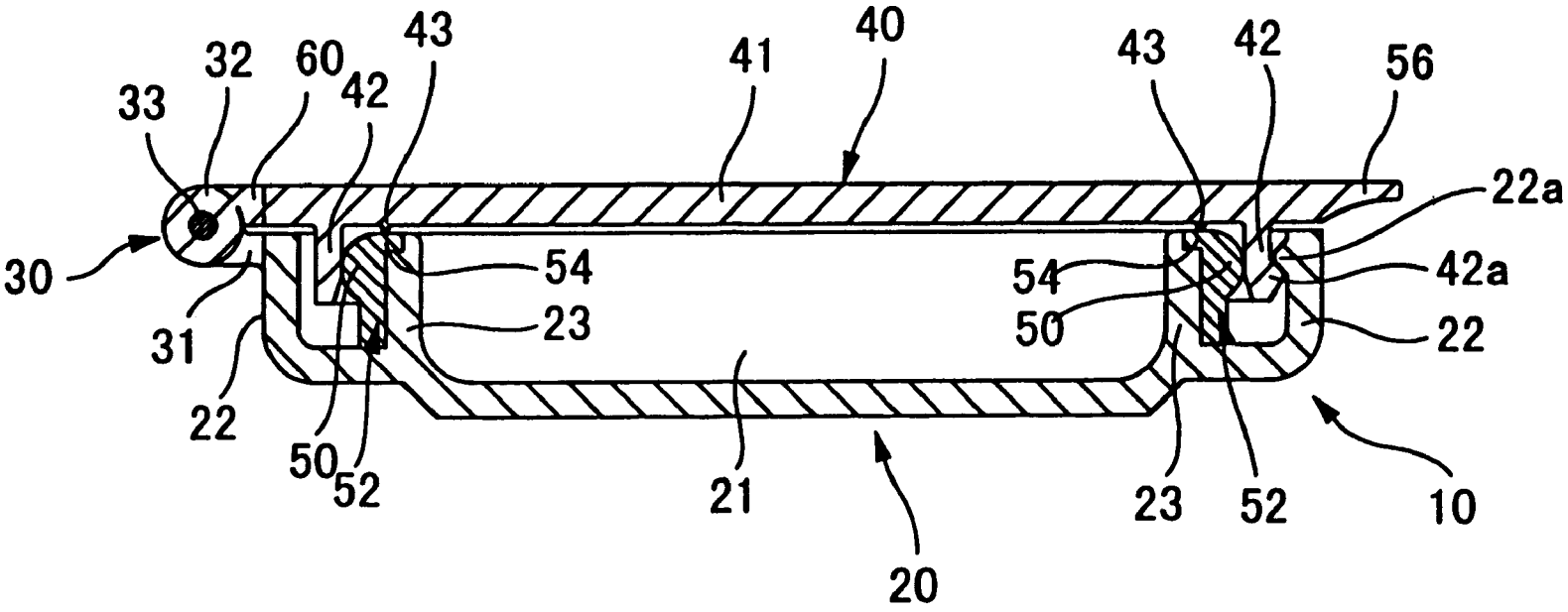
FIG. 12 is a side cross sectional view of the fourth embodiment with the cover closed.

FIGS. 10, 11, and 12 describe a fourth embodiment of the invention whereby the material connecting cover hinge boss 32 and cover 40 is formed to a thin horizontal section, thus establishing narrowly formed flange member 60 as an elastic deformation structure that only partially joins cover hinge boss 32 to cover 40.

Cover hinge boss 32 is joined to top plate 41 of cover 40 through narrow flange member 60. As shown in the figures, narrow flange member 60 is formed in an intersecting direction at the approximate center of hinge pin 33, thus establishing a gap between the ends of upper hinge boss 32 and cover 40. Hinge boss 32 is thus able move in various directions in relation to cover 40 as a result of the elastic deformation property of narrow flange member 60. Accordingly, hinge pin 33 is able to displace in fore-aft, horizontal, and vertical directions at any pivoting position while also torsionally twisting around narrow flange member 60. The structure put forth in this fourth embodiment provides for the same operational characteristics as that of the first embodiment.

Figure 13:
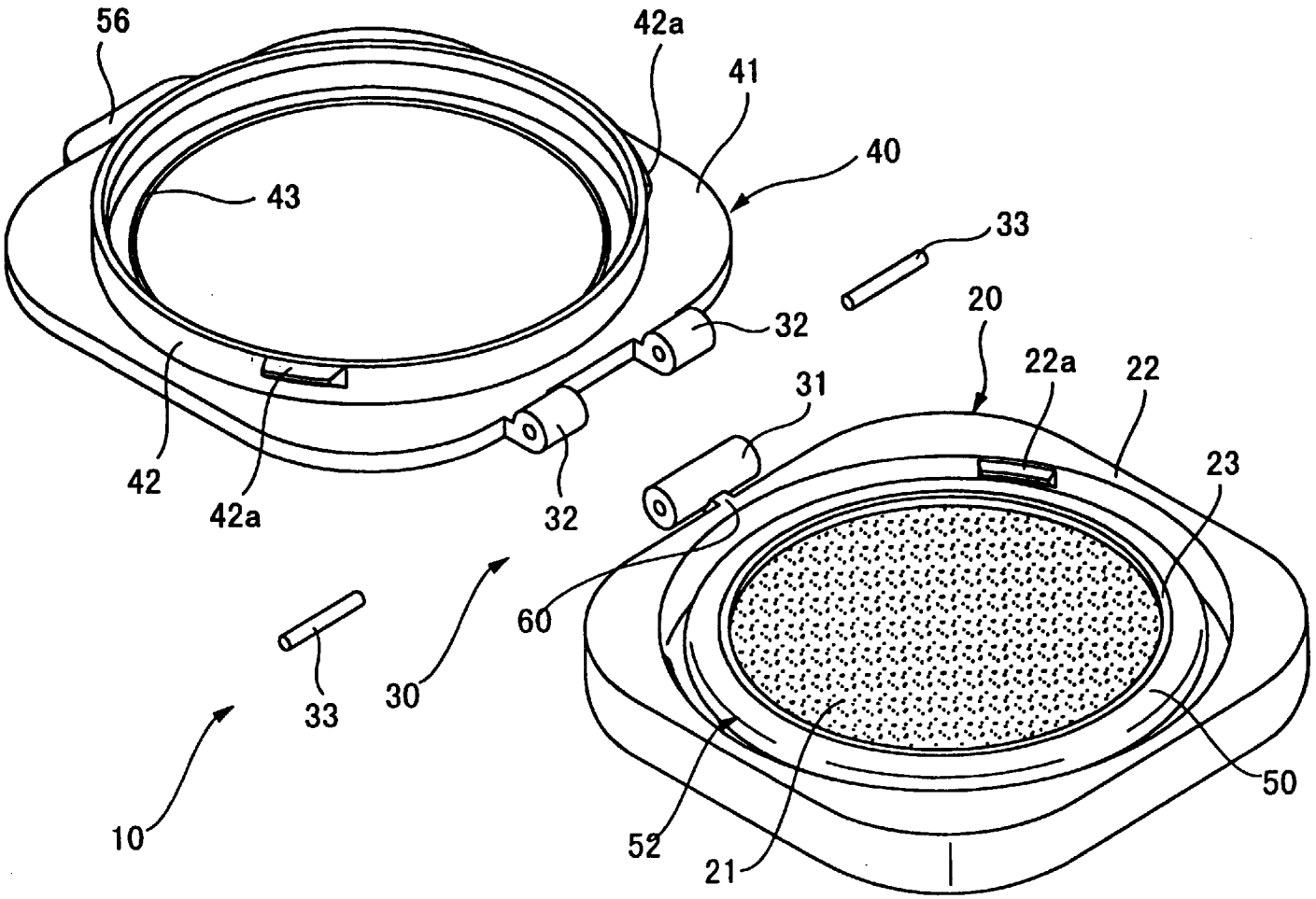
FIG. 13 is an oblique exploded view of the fifth embodiment of the invention.

FIG. 13 describes a fifth embodiment of the invention wherein the material connecting container hinge boss 31 and container 20 is narrowly formed to establish for narrow flange member 60 as an elastic deformation structure that only partially joins container hinge boss 31 to container 20.

In this fifth embodiment, hinge assembly 30 is comprised of two outwardly protruding cover hinge bosses 32 located on each side of the center of the rearward facing edge of cover 40, outwardly protruding container hinge boss 31 located at the center of the rearward facing edge of container 20 and located so as to fit between cover hinge bosses 32, and hinge pins 33 that are inserted into the bores of both cover hinge bosses 32 and container hinge boss 31.

Hinge boss 31 and sidewall 22 of container 20 are joined by means of narrow flange member 60. As shown in FIG. 13, narrow flange member 60 is formed in an intersecting direction at the approximate center of hinge pin 33, thus establishing a gap between the ends of container hinge boss 31 and container 20. Hinge boss 31 is thus able move in various directions in relation to container 20 as a result of the elastic deformation property provided by narrow flange member 60. Accordingly, hinge pin 33 is able to displace in fore-aft, horizontal, and vertical directions at any pivoting position while also torsionally twisting around narrow flange member 60. The structure put forth in this fifth embodiment provides for the same operational characteristics as that of the first embodiment.

Figure 14:
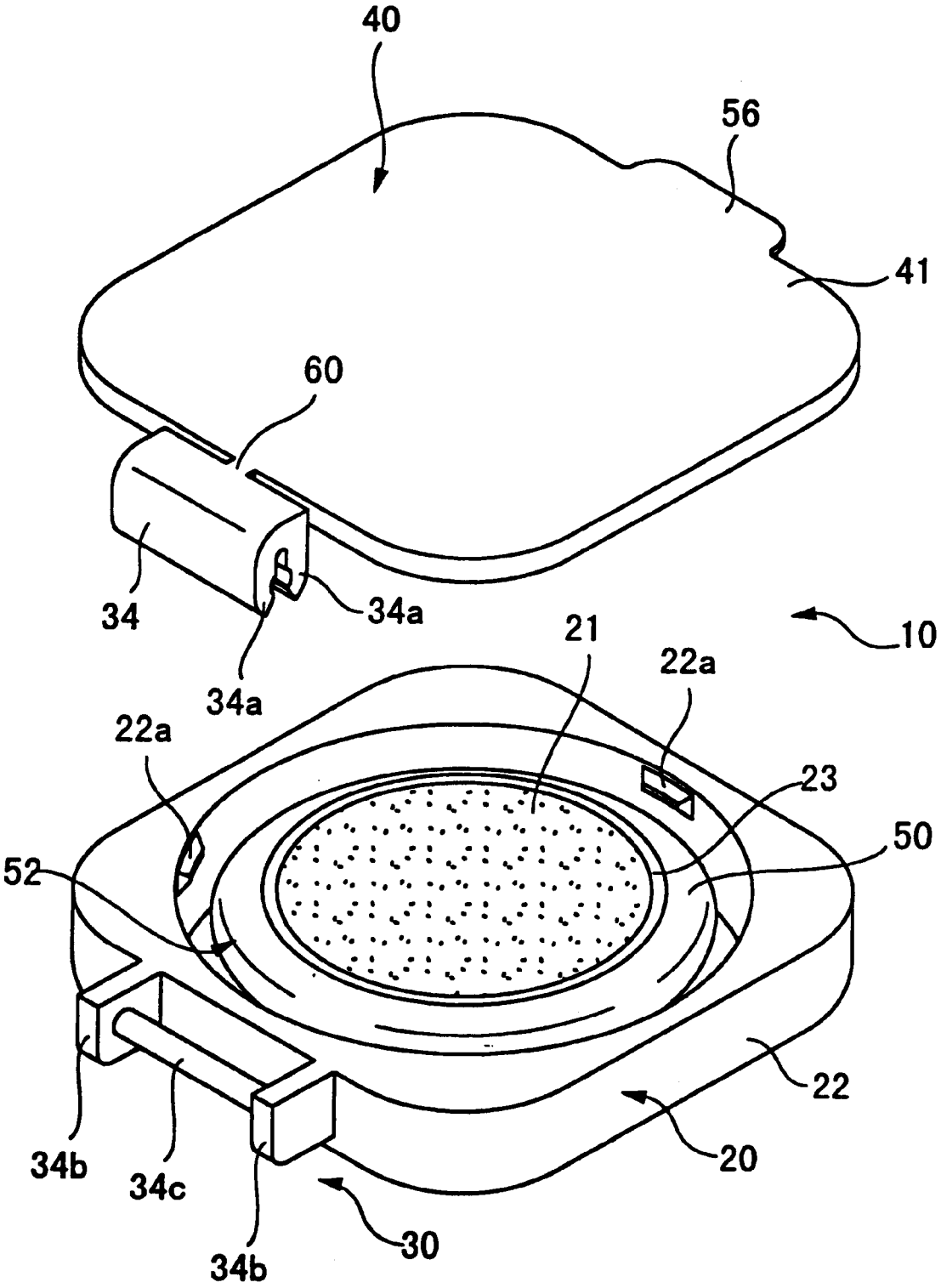
FIG. 14 is an oblique exploded view of the sixth embodiment of the invention.
Figure 15:
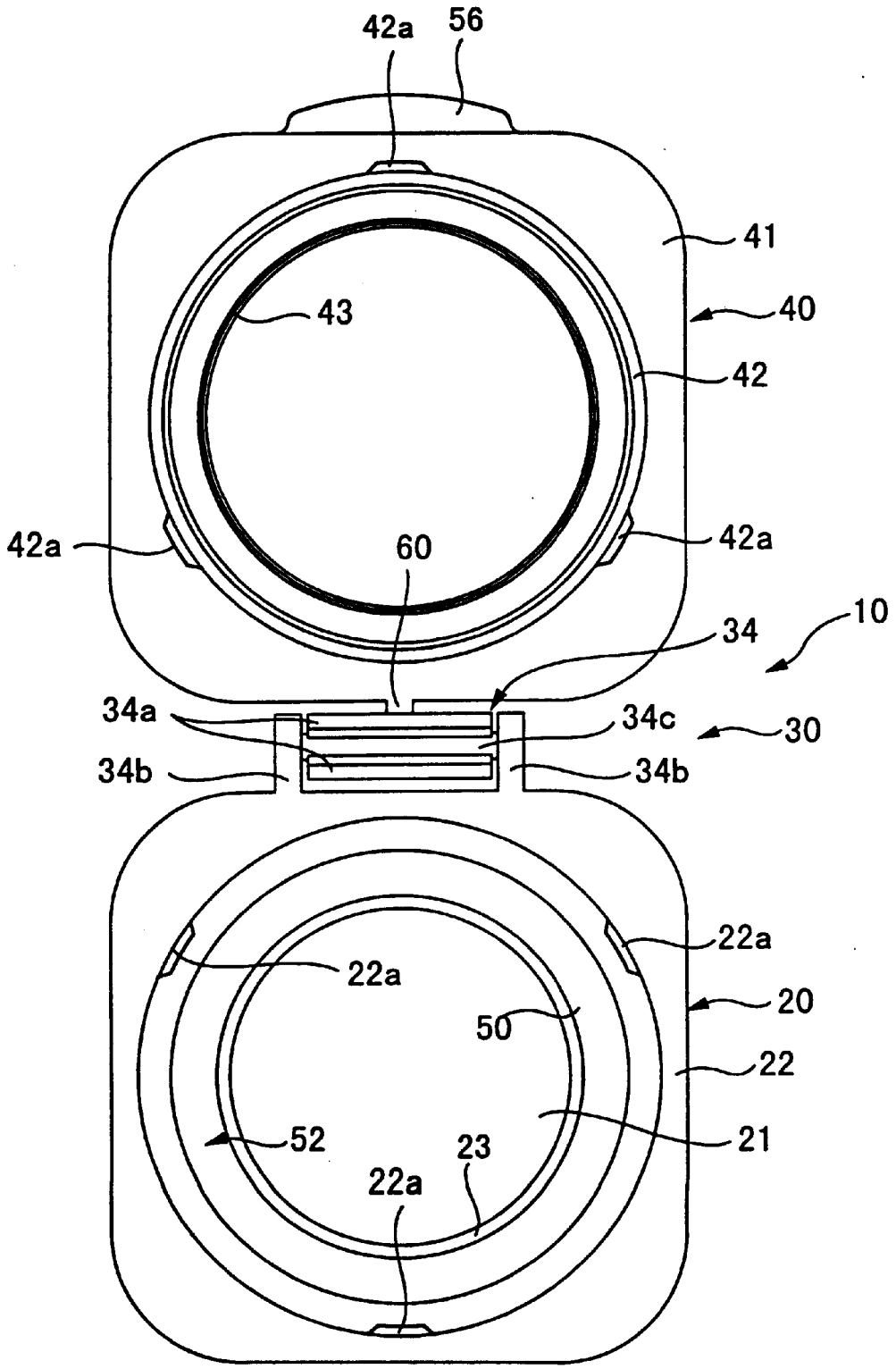
FIG. 15 is a plan view of the sixth embodiment with the cover open.
Figure 16:
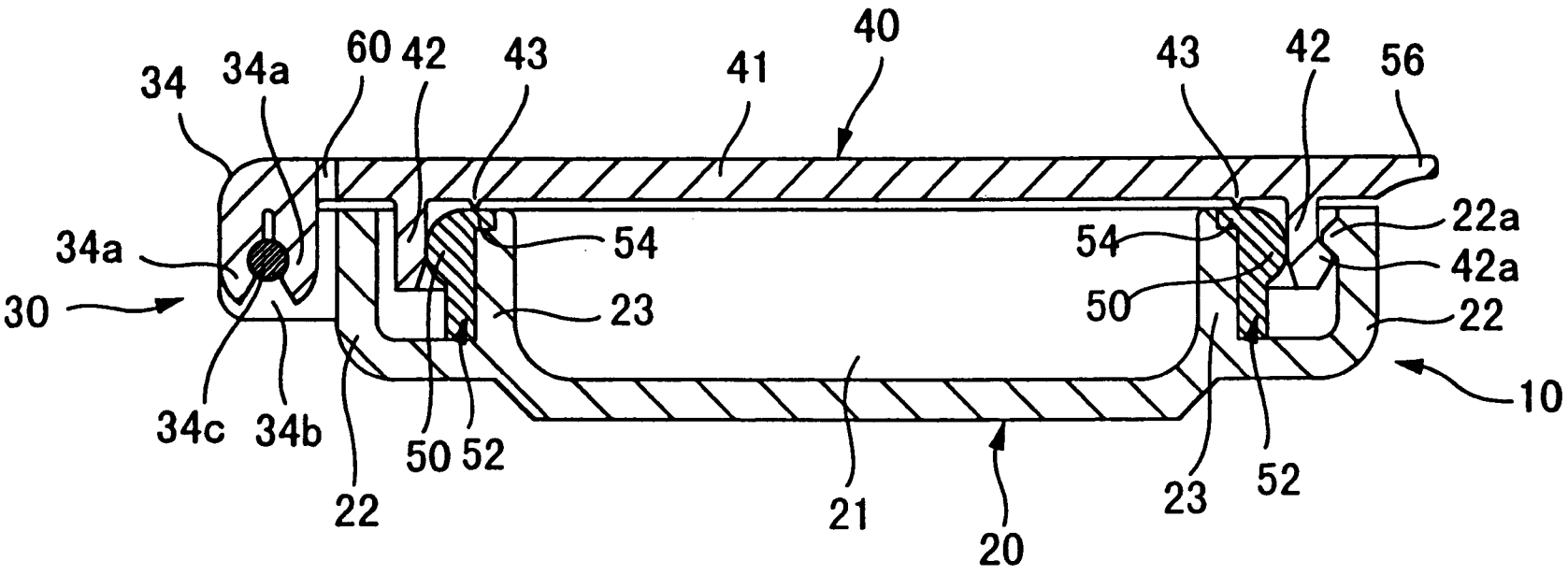
FIG. 16 is a side cross section of the sixth embodiment with the cover closed.
Figure 17:
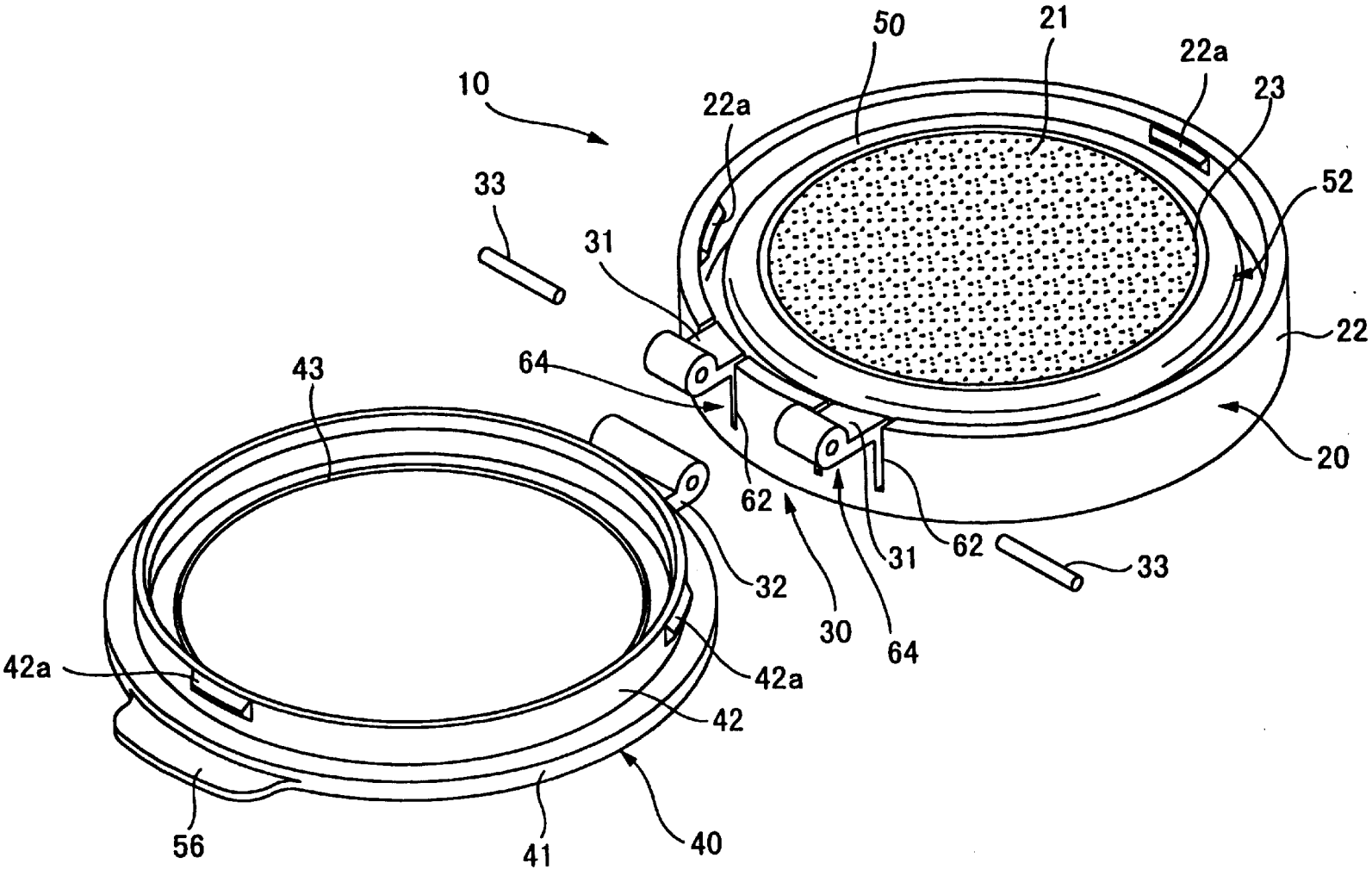
FIG. 17 is an exploded oblique view of the seventh embodiment of the invention.
Figure 18:
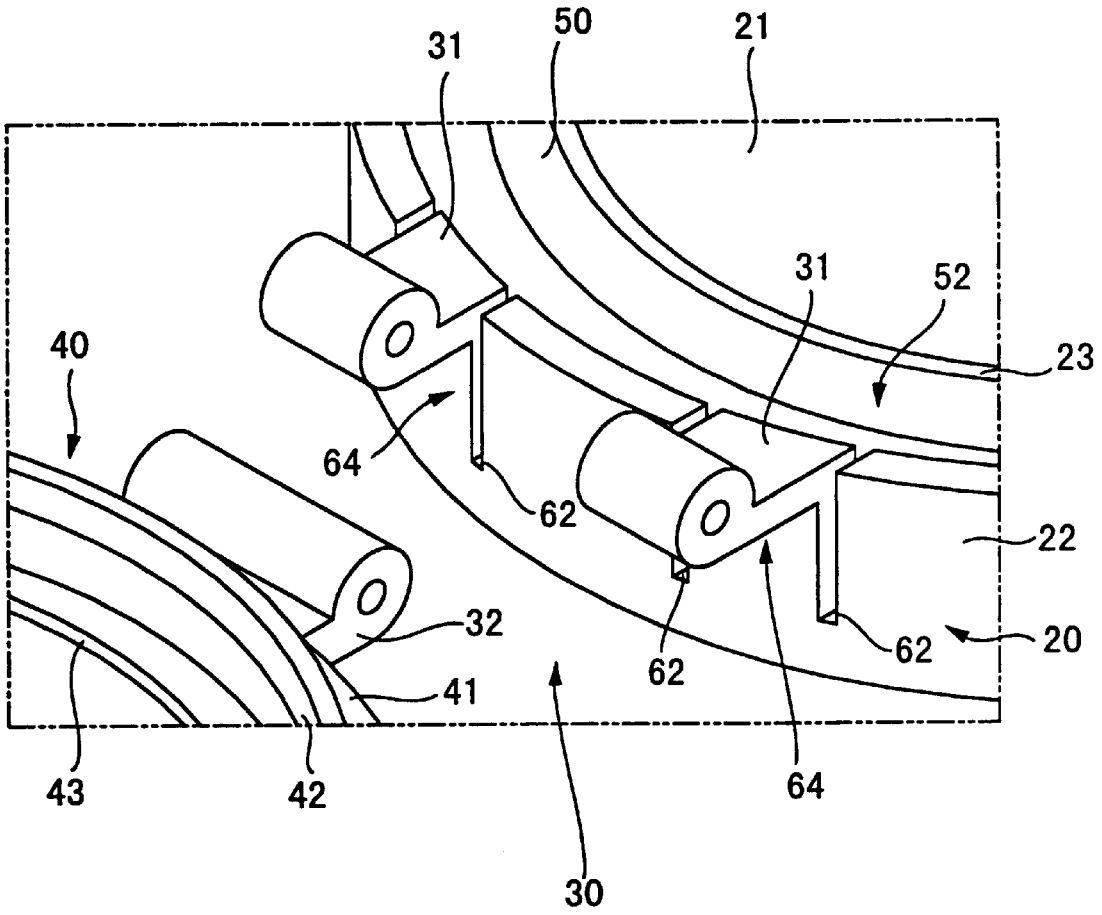
FIG. 18 is a detailed oblique view of the hinge assembly of the seventh embodiment.
Figure 19:
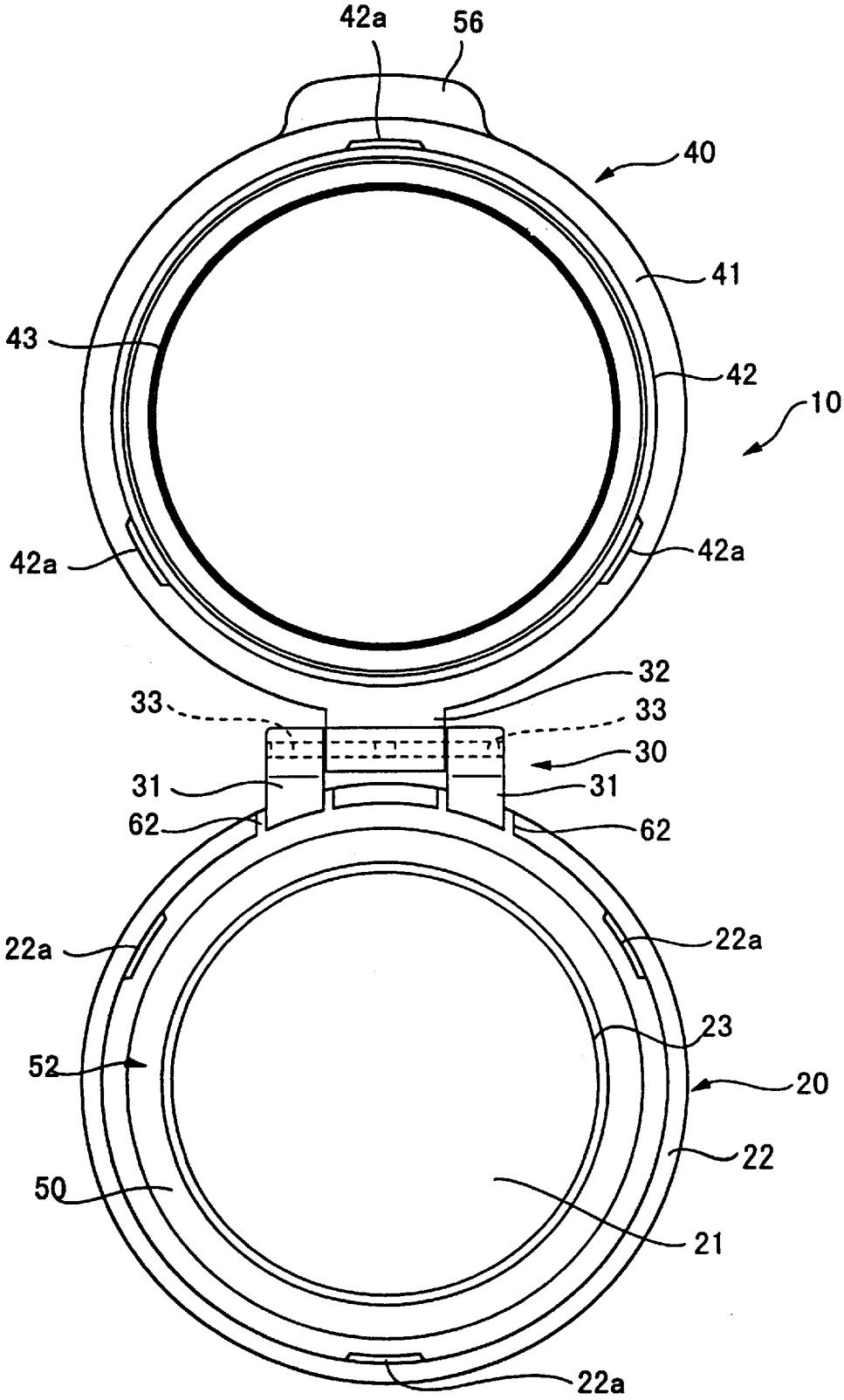
FIG. 19 is a plan view of the seventh embodiment with the cover open.
Figure 20:
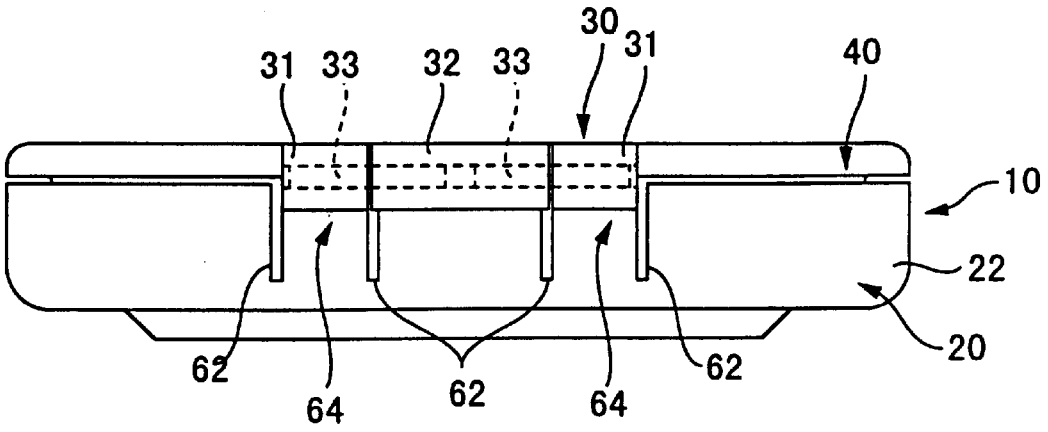
FIG. 20 is a rear view of the seventh embodiment with the cover closed.
Figure 21:
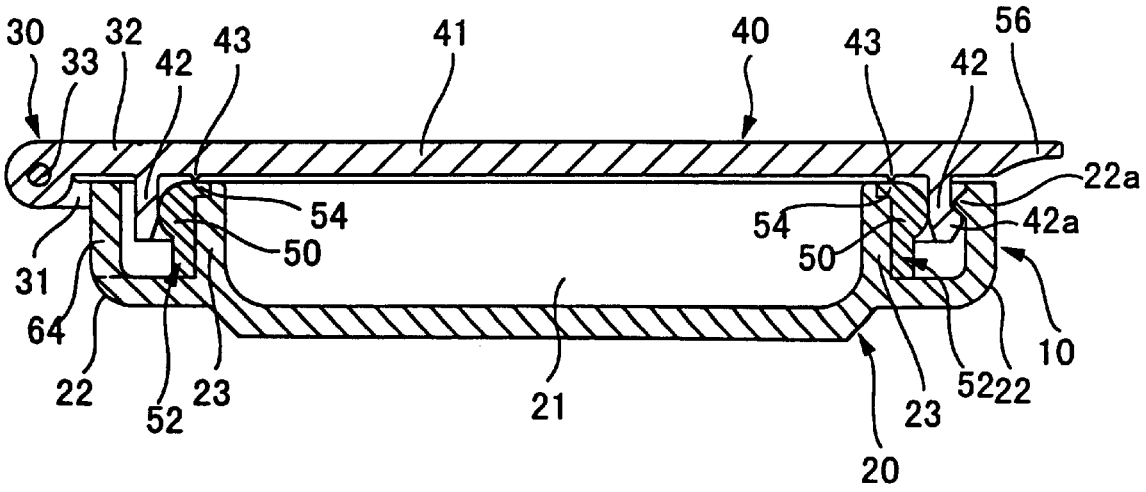
FIG. 21 is a side cross section view of the seventh embodiment with the cover closed.

FIGS. 14, 15, and 16 put forth a sixth embodiment of the invention wherein container 20 incorporates container hinge bosses 34*b*, cover 40 incorporates cover hinge boss 34, hinge pin 34*c* is formed between and as an integral part of container hinge bosses 34*b*, hinge channel 34*a* is formed within cover hinge boss 34 as means of forming a releasable pivoting connection with hinge pin 34*c*, and a pivoting joint is formed between container- hinge boss 34*b* and cover hinge boss 34. Cover hinge boss 34 is of narrow horizontal cross section where it joins to cover 40, thus forming narrow flange member 60 as an elastic deformation structure that only partially joins cover hinge boss 34 to cover 40.

In this sixth embodiment, two container hinge bosses 34*b* protrude from the center of the rearward facing edge of container 20, and hinge pin 34*c* is formed between and as an integral part of hinge bosses 34*b*. Downwardly facing pin slot 34*a* is formed within cover hinge boss 34 on the rearward-facing edge of cover 40. Cover hinge boss 34 inserts between container hinge bosses 34*b* to form a pivoting joint between hinge pin 34*c* and pin joint slot 34*a*, thus forming releasable hinge assembly 30. In a similar manner as explained in the fourth embodiment, cover 40 is joined to cover hinge boss 34 through narrow flange member 60, thus providing for a structure that allows the positional displacement of cover 40 in various directions through the elastic deformation property provided by member 60. Therefore, this sixth embodiment provides for the same operational characteristics as the first embodiment.

Utilizing this type of hinge structure, hinge assembly 30 can be assembled by simply pushing pin joint slot 34*a* down onto hinge pin 34, thus eliminating the need to insert the hinge pin into multiple hinge bores. Moreover, because cover 40 can be easily separated from container 20, the operation through which space 21 is filled with cosmetic material is simplified, thus providing for a more streamlined manufacturing process that can reduce costs. The alternative to the above structure is that the container may be joined to the container hinge boss through narrow flange member.

Furthermore, while this embodiment proposes that cover hinge boss 34 be narrowly formed where it connects cover 40 to hinge pin 34*c*, a structure may also be utilized whereby the narrowly formed part is formed as a thin plate-like member.

Moreover, while this embodiment explains hinge boss 34*b* as being narrowly formed between hinge pin 34*c* and container 20, a structure may also be employed whereby the narrowly formed part of hinge boss 34*b* is formed as a thin plate-like member.

FIGS. 17 through 21 describe a seventh embodiment of the invention. Container 20 incorporates side wall 22 encompassing cosmetic space 21, cover 40 and cover plate 41 that close over cosmetic space 21, flat spring member 64 provided either on side wall 22 or cover plate 41, and hinge pin 33 forming a pivoting joint, supported by flat spring member 64, between side wall 22 and cover plate 41. Vertically oriented parallel slits 62 are formed within sidewall 22 as means of establishing flat spring member 64 as an integral part of sidewall 22.

In this seventh embodiment, two pairs of vertically oriented slits 62 are provided within sidewall 22 as means of forming flat spring members 64, and case hinge bosses 31 are thus formed as cantilevered sections of sidewall 22 suspended between slits 62. Container hinge bosses 31 are thus allowed to elastically displace in an inward or outward direction by means of the spring displacement property provided by flat spring members 64. Hinge pin 33 is thus able to pivot while also moving in fore-aft, horizontal, and vertical directions.

Container hinge boss 31 is cantilevered out from the end of flat spring 64 in a manner as to allow its free displacement in the vertical direction. Because boss 31 protrudes outward from the top of flat spring member 64, hinge pin 33 is able to freely change position as a result of the elastic deformation property provided by both flat spring 64 and container hinge boss 31. This seventh embodiment thus provides the same operational characteristics as the first embodiment.

Figure 22:
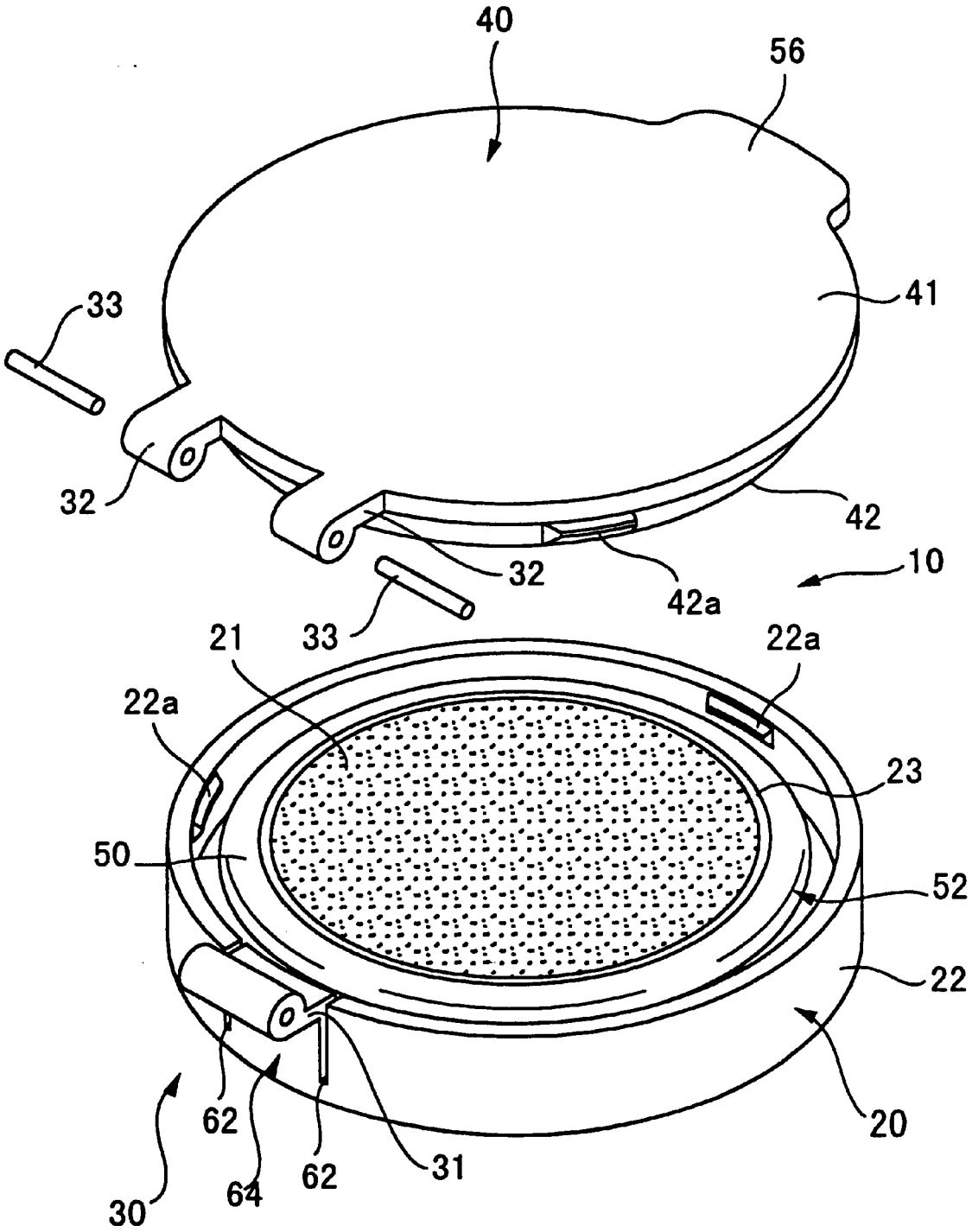
FIG. 22 is an exploded oblique view of the eighth embodiment of the invention.

FIG. 22 describes an eighth embodiment of the invention wherein only one hinge boss 31 is provided on a single flat spring member 64 formed between adjacent slits 62 opened within sidewall 22 of container 20. Container hinge boss 31 is thus able to physically displace as a result of the elastic deformation property provided by flat spring member 64 in the same manner as explained in the seventh embodiment. This eighth embodiment also provides for the same operating characteristics as described in the first embodiment.

Figure 23:
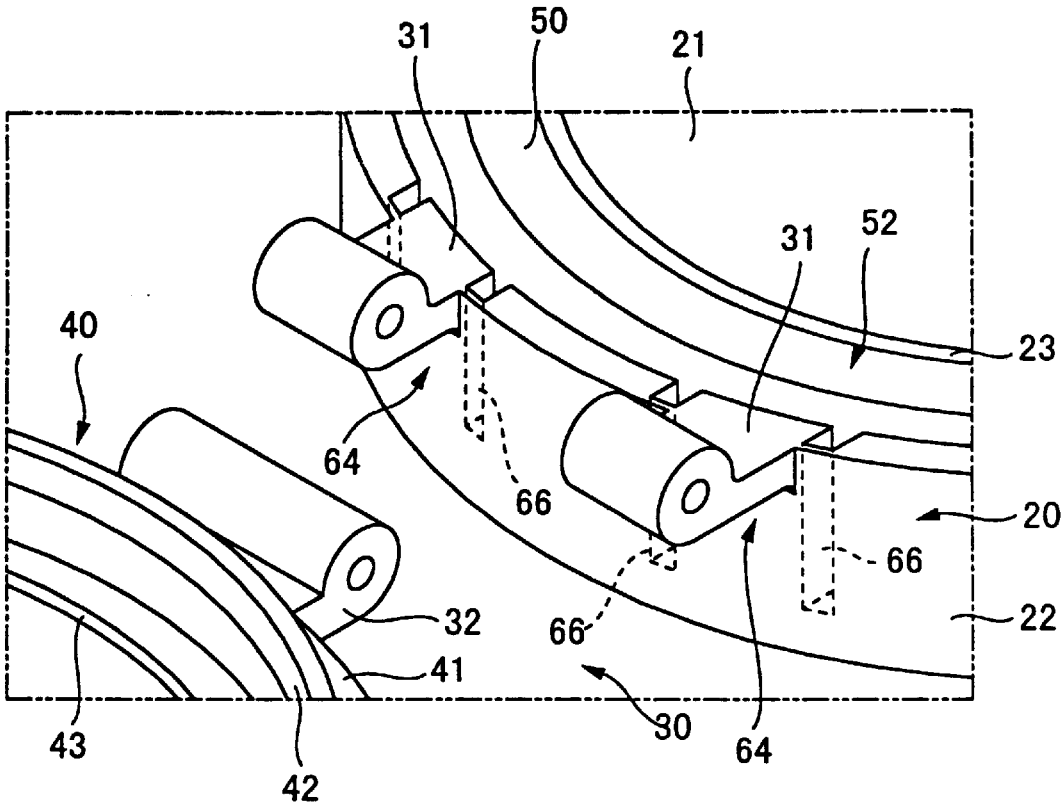
FIG. 23 is a detailed oblique view of the hinge assembly of the ninth embodiment.
Figure 24:
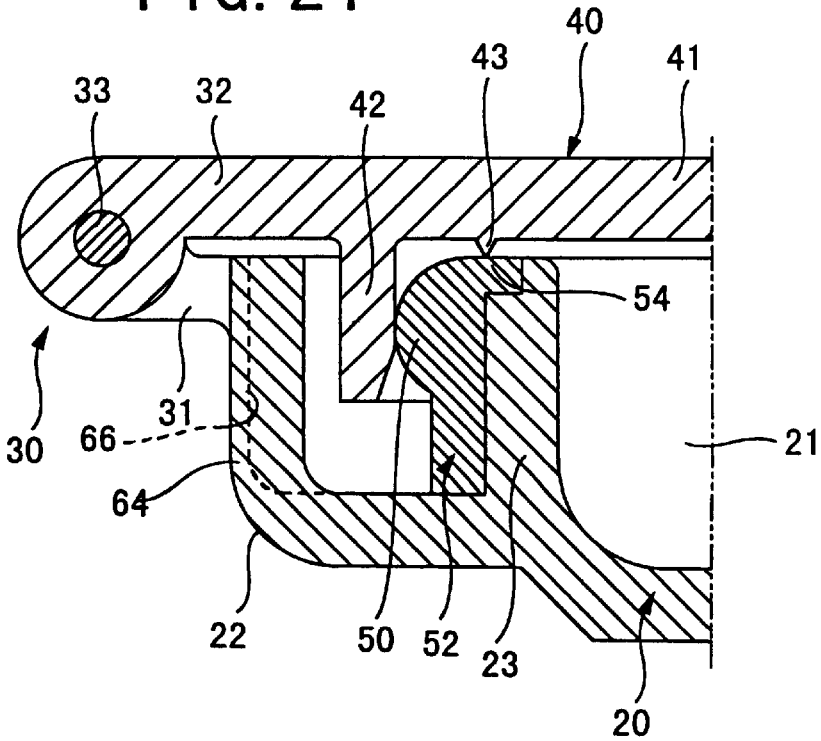
FIG. 24 is a detailed cross section of the hinge and sealing structure of the ninth embodiment with the cover closed.

FIGS. 23 and 24 describe a ninth embodiment of the invention wherein flat spring member 64 is formed by means of vertically oriented parallel grooves 66 located on the inner perimeter of sidewall 22.

In this ninth embodiment, grooves 66 are utilized in place of slits 62 as means of establishing flat spring member 64. That is, flat spring member 64 is formed as a partially cantilevered member vertically supported by the thin wall section formed at the bottom of grooves 66. As the figure illustrates, grooves 66 are formed on the inner perimeter of sidewall 22, thus providing for a structure which, as explained in the seventh embodiment, allows container hinge bosses 31 to physically displace as a result of the elastic deformation property provided by flat spring member 64. This ninth embodiment also provides for the same operating characteristics as explained in the first embodiment.

As grooves 66 are provided on the inner perimeter of sidewall 22, the externally facing surface of container 20 is able to maintain a smooth uninterrupted surface that enhances the appearance of the cosmetic case while preventing the invasion of foreign matter into the case.

Flat spring member 64 may also be established as a mounting component for the cover hinge boss by forming similar parallel grooves in cover plate 41.

Figure 25:
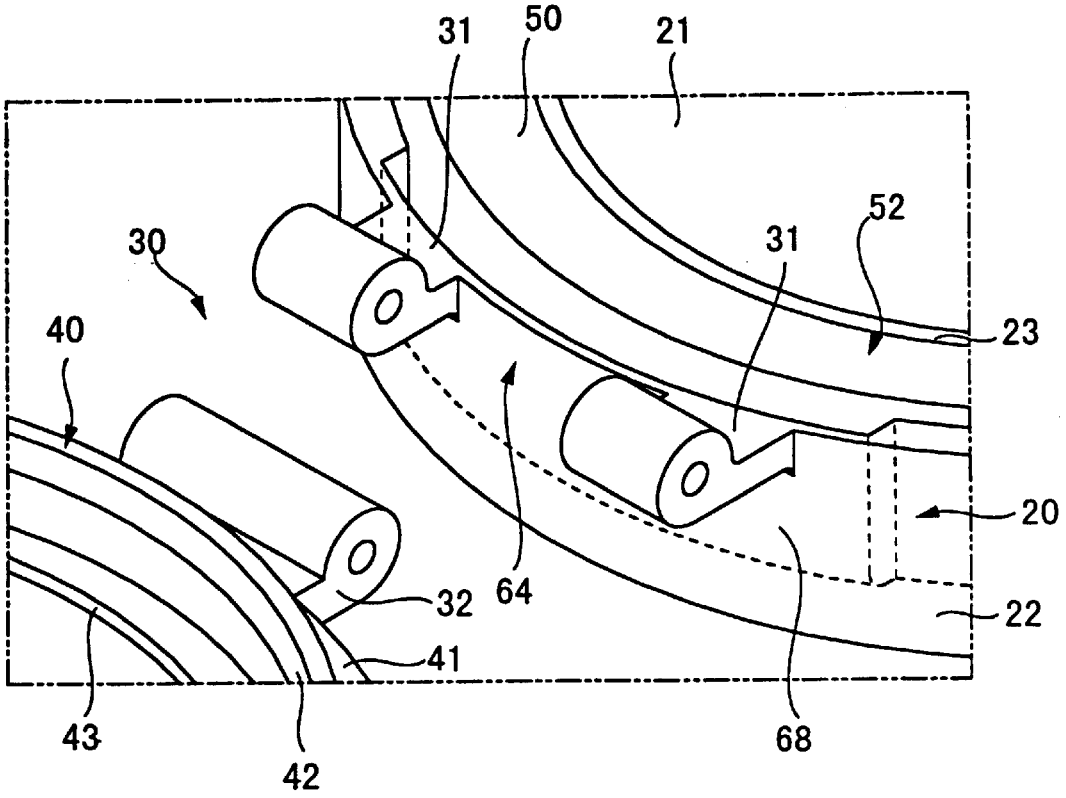
FIG. 25 is an exploded oblique view of the tenth embodiment of the invention.
Figure 26:
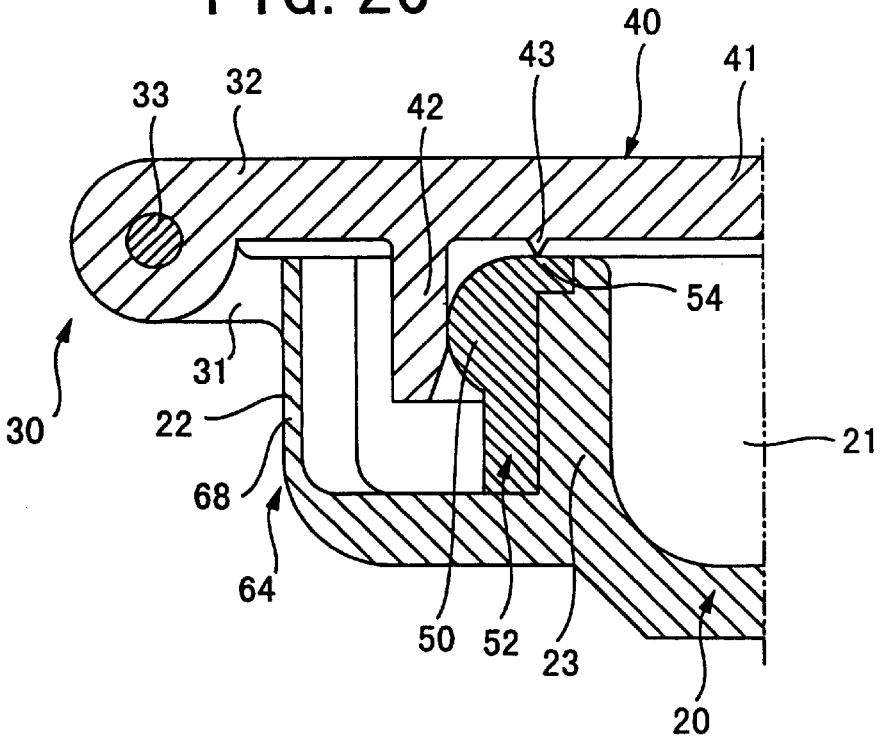
FIG. 26 is a detailed cross section of the hinge and sealing structure of the tenth embodiment.

FIGS. 25 and 26 describe a tenth embodiment of the invention wherein thin wall section 68 is formed within sidewall 22 and utilized to obtain the same operational characteristics as those provided by flat spring member 64.

In this tenth embodiment, thin wall section 68 is utilized in place of slits 62 or grooves 66 which formerly defined flat spring member 64. Thin wall section 68, which incorporates two container hinge bosses 31, is formed by means of an indentation within the internal perimeter of sidewall 22, extends from the top of sidewall 22 to its bottom, and thus allows sidewall 22 itself to provide the same effect as that obtained by flat spring member 64. In the same manner as explained previously in the seventh embodiment, thin wall section 68 provides an elastic deformation property that allows the positional displacement of container hinge boss 31. This tenth embodiment offers the same operation effect as explained in the first embodiment.

Moreover, thin wall section 68 provides the same benefits as grooves 66 of the ninth embodiment in that the surface of the perimeter of container 20 is unbroken and foreign matter is unable to invade container 20. Furthermore, a more compliant elastic deformation property is obtained over that provided by flat spring member 64 as formed by grooves 66.

Flat spring member 64, as formed by thin wall section 68 in this tenth embodiment, may also be structured in the same manner as part of cover plate 41.

Figure 27:
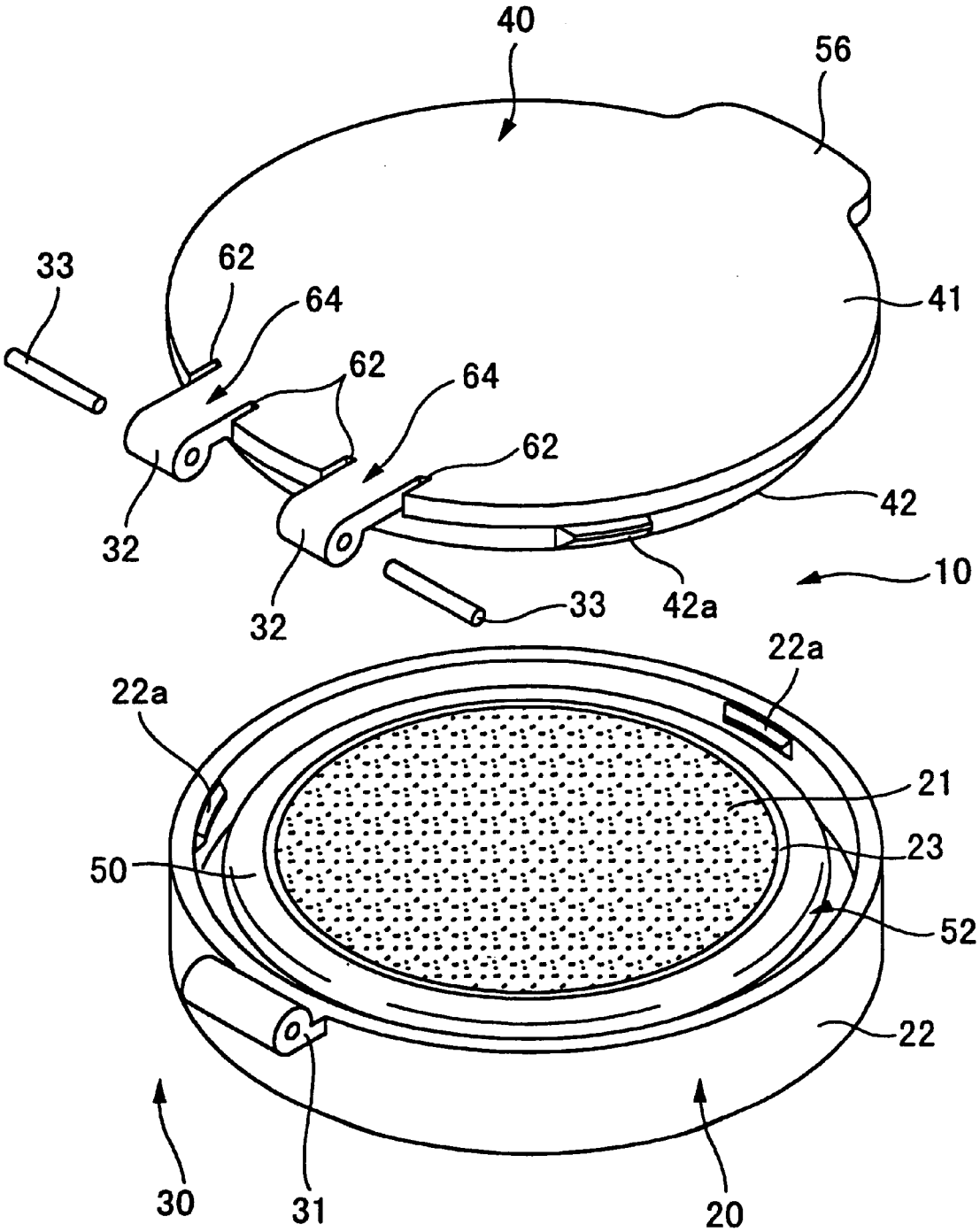
FIG. 27 is an exploded oblique view of the eleventh embodiment of the invention.

FIG. 27 describes an eleventh embodiment of the invention wherein flat spring member 64 is formed within cover plate 41 by means of parallel slits 62.

In this eleventh embodiment, two pairs of parallel slits 62 are opened inwardly from the perimeter of cover 40 into cover plate 41 as means of forming a pair of cover hinge bosses 32. This structure thus allows a part of cover plate 41 to become as a cantilevered section forming flat spring member 64. In the same manner as explained in the seventh embodiment, cover hinge boss 32 is able to positionally displace as a result of the elastic deformation property of flat spring member 64. This structure provides for the same operational effect as obtained in the first embodiment.

Moreover, cover hinge bosses 32 are able to elastically deform in the vertical direction. Because hinge boss 32 protrudes outwardly on the end of flat spring 64, the positions of hinge pins 33 are able to change independently as a result of the elastic deformation of flat spring 64 and cover hinge bosses 32.

What is claimed is:

1. A cosmetic case comprised of:

a container part within which a cosmetic holding space is provided;

a cover part capable of pivotably exposing or sealing said cosmetic holding space;

a hinge pin provided between said cover part and container part as means of allowing their pivotal movement thereon;

a latch mechanism capable of releaseably securing said cover part against said container part;

a packing piece provided as means of forming an atmospherically tight seal between said cover part and cosmetic holding space according to a securing motion of said latch mechanism;

an elastic deformation structure formed on said container part as a means of allowing a positional displacement of said hinge pin when said cover part is held closed against said container part by said latch mechanism;

said container part incorporates a container hinge boss;

said hinge pin inserts through both of said hinge bosses to form a pivoting joint; and said elastic deformation structure is provided between said hinge pin and container part as part of said container hinge boss narrowly formed so as to provide a predominantly open space between said hinge pin and container part.

2. A cosmetic case as put forth in claim 1 wherein said hinge pin is formed as an integral part of either said container hinge boss or cover hinge boss, the oppositely facing hinge boss incorporates a releasable hinge joint forming part.

3. A cosmetic case comprised of:

a container part within which a cosmetic holding space is provided;

a cover part capable of pivotably exposing or sealing said cosmetic holding space;

a hinge pin provided between said cover part and container part as meas of allowing their pivotal movement thereon;

a latch mechanism capable of releasably securing said cover part against said container part;

a packing piece provided as means of forming an atmospherically tight seal between said cover part and cosmetic holding space according to a securing motion of said latch mechanism;

an elastic deformation structure formed on said cover part as means of allowing a positional displacement of said hinge pin when said cover part is held closed against said container part by said latch mechanism;

said container part incorporates a container hinge boss;

said cover incorporates a cover hinge boss;

said hinge pin inserts through both of said hinge bosses to form a pivoting joint, and said elastic deformation structure is provided between said hinge pin and cover part as part of said cover hinge boss narrowly formed so as to provide a predominantly open space between said hinge pin and cover part.

4. A cosmetic case as put forth in claim 3 wherein said hinge pin is formed as an integral part of either said container hinge boss or cover hinge boss, the oppositely facing hinge boss incorporates a releasable hinge joint forming part.

5. A cosmetic case comprised of:

a container part within which a cosmetic holding space is provided;

a cover part capable of pivotably exposing or sealing said cosmetic holding space, a hinge pin provided between said cover part and container part as means of allowing their pivotal movement thereon;

a latch mechanism capable of releaseably securing said cover part against said container part;

a packing piece provided as means of forming an atmospherically tight seal between said cover part and cosmetic holding space according to a securing motion of said latch mechanism; and an elastic deformation structure formed either on said cover part or container part as means of allowing a positional displacement of said hinge pin when said cover part is held closed against said container part by said latch mechanism;

said container part incorporates a sidewall and a cover plate able to dose over said container part;

said elastic deformation structure is provided as a flat spring structure with either said sidewall or cover plate; and said hinge pin mutually joins said sidewall and cover plate through said flat spring structure.

6. A cosmetic case as put forth in claim 5 herein said flat spring structure is formed by means of adjacent vertical parallel slits provided in said sidewall.

7. A cosmetic case as put forth in claim 5 wherein said flat spring structure is formed by adjacent vertical parallel grooves provided in said sidewall.

8. A cosmetic case as put forth in claim 5 wherein said flat spring structure is formed by means of a portion of said sidewall having a thinner cross section.

9. A cosmetic case as put forth in claim 5 wherein said flat spring structure is formed by adjacent horizontal parallel slits provided in said cover plate.

10. A cosmetic case as put forth in claim 5 wherein said flat spring structure is formed by adjacent horizontal parallel grooves provided in said cover plate.

11. A cosmetic case as put forth in claim 5 wherein said flat spring structure is formed by means of a portion of said cover plate having a thinner cross section.

* * * * *